US006194131B1

(12) United States Patent
Ito et al.

(10) Patent No.: US 6,194,131 B1
(45) Date of Patent: Feb. 27, 2001

(54) SILVER HALIDE COLOR PHOTOGRAPHIC LIGHTSENSITIVE MATERIAL

(75) Inventors: Takayuki Ito; Hidetoshi Kobayashi, both of Minami-Ashigara (JP)

(73) Assignee: Fuji Photo film Co., Ltd., Kangawa (JP)

( * ) Notice: Subject to any disclaimer, the term of this patent is extended or adjusted under 35 U.S.C. 154(b) by 0 days.

(21) Appl. No.: 09/577,497

(22) Filed: May 24, 2000

(30) Foreign Application Priority Data

May 24, 1999 (JP) ..... 11-143327

(51) Int. Cl.[7] ..... G03C 1/08; G03C 7/26; G03C 7/32

(52) U.S. Cl. ..... 430/543; 430/955; 430/552; 430/553; 430/554; 430/555; 430/556; 430/557; 430/558

(58) Field of Search ..... 430/543, 552, 430/553, 554, 555, 556, 557, 558, 955

(56) References Cited

U.S. PATENT DOCUMENTS 6,107,016 * 8/2000 Ito et al. ..... 430/544

FOREIGN PATENT DOCUMENTS 59-171955 9/1984 (JP) .
1-129252 5/1989 (JP) .

* cited by examiner

*Primary Examiner*—Geraldine Letscher
(74) *Attorney, Agent, or Firm*—Birch, Stewart, Kolasch & Birch, LLP

(57) ABSTRACT

A silver halide color photographic lightsensitive material comprising a compound represented by general formula (I):

COUP—A—E—B (I)

wherein COUP represents a coupler residue capable of coupling with a developing agent in an oxidized form, E represents an electrophilic moiety, A represents a single bond or a divalent connecting group which can release B while forming a 4 to 8-membered ring through an intramolecular nucleophilic substitution reaction between the electrophilic moiety E and a nitrogen atom of a coupling product that is obtained by the reaction of COUP with the developing agent in an oxidized form, wherein the nitrogen atom originates from the developing agent and directly binds to a coupling position of COUP, provided that A may be bound to COUP at the coupling position or position other than the coupling position of COUP, and B represents a photographically inert group.

9 Claims, No Drawings

SILVER HALIDE COLOR PHOTOGRAPHIC LIGHTSENSITIVE MATERIAL

CROSS-REFERENCE TO RELATED APPLICATIONS

This application is based upon and claims the benefit of priority from the prior Japanese Patent Application No. 11-143327, filed May 24, 1999, the entire contents of which are incorporated herein by reference.

BACKGROUND OF THE INVENTION

The present invention relates to a silver halide photographic lightsensitive material which is excellent in color reproduction and graininess. More particularly, the present invention relates to a silver halide photographic lightsensitive material which contains a novel compound capable of rapidly trapping developing agent oxidation products.

The method of forming color images by first exposing a silver halide color photographic lightsensitive material and subsequently processing the exposed material with a color developing solution containing a developing agent of an aromatic primary amine, is well known for long. In this method, generally, the subtractive color processes are employed for color reproduction, and use is made of silver halide emulsions which are selectively sensitive to blue, green and red, in which agents for forming respectively complementary yellow, magenta and cyan color images (couplers) are contained.

With respect to this color forming method, it is known to add a compound capable of effectively trapping developing agent oxidation products in order to avoid such problems that fogging and graininess deterioration are caused by reactions between developing agent oxidation products produced in excess and couplers and that produced developing agent oxidation products are diffused into other layers to thereby bring about color turbidity.

Redox compounds are known as providing such a trapping agent for developing agent oxidation products, which redox compounds include, for example, ballasted hydroquinone (1,4-dihydroxybenzene) compounds described in U.S. Pat. Nos. 3,700,453 and 4,732,845, ballasted gallic acid (1,2,3-trihydroxybenzene) compounds described in U.S. Pat. No. 4,474,874, ballasted sulfonamidophenols described in U.S. Pat. Nos. 4,205,987 and 4,447,523, ballasted resorcinol (1,3-dihydroxybenzene) compounds described in U.S. Pat. No. 3,770,431 and hydrazide compounds described in U.S. Pat. No. 5,230,992, Jpn. Pat. Appln. KOKAI Publication No. (hereinafter referred to as JP-A-) 4-238347 and JP-A-8-240892. However, it is very difficult for these redox compounds to be excellent in both capability of trapping developing agent oxidation products (hereinafter referred to as "activity") and stability. Redox compounds with high activity have a drawback in that, when stored for long, they adversely affect the silver halide emulsion to thereby cause fogging and disorder of gradation. On the other hand, redox compounds with enhanced stability suffers from a lowering of activity. Moreover, it is not less frequent that such redox compounds per se form colored residue by trapping developing agent oxidation products.

As other forms of trapping agents for developing agent oxidation products, there are known systems utilizing coupling reactions, such as colorless compound forming couplers which couple with developing agent oxidation products to thereby form substantially colorless compounds as described in, for example, U.S. Pat. No. 3,876,428, JP-A-50-150434 and Jpn. Pat. Appln. KOKOKU Publication No. (hereinafter referred to as JP-B-) 57-51662 and outflowing dye forming couplers which form water-soluble dyes by coupling substantially not to thereby contribute to image formation as described in, for example, JP-A's-59-171955, 1-129252 and 6-138612. However, the former colorless compound forming couplers have a drawback in that the activity thereof is so low that a large amount of colorless compound forming coupler must be used for exerting the desired effect. On the other hand, the latter outflowing dye forming couplers, although both activity and stability can be relatively easily attained by optimizing the coupler nucleus and split-off groups thereof, have the danger of contaminating the processing solutions because of the outflow of formed dyes into the processing solutions. This contamination of the processing solutions is unfavorable in these days in which the reduction of replenisher for the processing solutions is being demanded. Further, the structure of the above outflowing dye forming couplers is so complex that it is not few that the production cost thereof is high.

BRIEF SUMMARY OF THE INVENTION

The object of the present invention is to provide a silver halide lightsensitive material which contains a novel trapping agent for developing agent oxidation products that is highly active, ensures excellent storage stability, can be produced at low cost and is free from the danger of contaminating processing solutions, and which is further improved in graininess.

The object of the present invention has been attained by a silver halide color photographic lightsensitive material characterized by containing a compound represented by the general formula:

$$\text{COUP—A—E—B} \qquad \text{(I)}$$

wherein COUP represents a coupler residue capable of coupling with a developing agent oxidation product; E represents an electrophilic moiety; A represents a single bond or divalent connecting group which can release B while forming a 4 to 8-membered ring through an intramolecular nucleophilic substitution reaction between the electrophilic moiety E and a nitrogen atom of a coupling product of COUP with a developing agent oxidation product, the nitrogen atom being attributed to the developing agent and directly bonded to a coupling position of COUP, provided that A may be bonded to COUP at the coupling position or position other than the coupling position of COUP; and B represents a photographically inert group.

DETAILED DESCRIPTION OF THE INVENTION

The trapping agent for developing agents in an oxidized form, hereinafter also referred to as developing agent oxidation products, for use in the silver halide color photographic lightsensitive material of the present invention (hereinafter also referred to as "the sensitive material of the present invention" or "the lightsensitive material of the present invention") will be described in detail below.

The trapping agent for developing agent oxidation products for use in the present invention is one characterized by coupling with a developing agent oxidation product to form a coupling product, thereby the developing agent oxidation products can be trapped. The coupling product subsequently forms a ring substantially not contributing to color image formation through an intramolecular nucleophilic substitution reaction with a nitrogen atom of the coupling product. The nitrogen atom originates from the developing agent and directly bonds to a coupling position of the trapping agent. This characteristic is exhibited by the coupler represented by the general formula:

$$\text{COUP—A—E—B} \qquad \text{(I).}$$

In the formula, the coupler residue represented by COUP may be any of yellow coupler residues (for example, openchain ketomethine coupler residues such as acylacetanilide and malondianilide), magenta coupler residues (for example, 5-pyrazolone and pyrazolotriazole coupler residues) and cyan coupler residues (for example, phenol, naphthol and pyrrolotriazole coupler residues) which are generally known as photographic couplers, or may be any of yellow, magenta or cyan dye forming coupler residues having novel skeletons described in, for example, U.S. Pat. No. 5,681,689, JP-A's-7-128824, 7-128823, 6-222526, 9-258400, 9-258401, 9-269573 and 6-27612, all the disclosures of which are herein incorporated by reference. Further, the coupler residue represented by COUP may be selected from among other coupler residues (for example, coupler residues capable of reacting with oxidation products of an aromatic amine developing agent to thereby form colorless substances as described in, for example, U.S. Pat. Nos. 3,632,345 and 3,928,041, the disclosures of which are herein incorporated by reference, and coupler residues capable of reacting with oxidation products of an aromatic amine developing agent to thereby form black or intermediate-color substances as described in, for example, U.S. Pat. Nos. 1,939,231 and 2,181,944, the disclosures of which are herein incorporated by reference).

The coupler residue represented by COUP may be a monomer, or part of a dimer coupler or an oligomer or polymer coupler. In the latter case, more than one —A—E—B group may be contained in the coupler.

Preferred examples of residues COUP for use in the present invention are as follows, which however do not limit those usable in the present invention:

(I-1A)

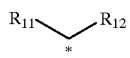

(I-2A)

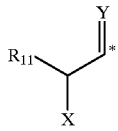

(I-1B)

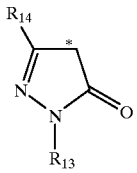

(I-2B)

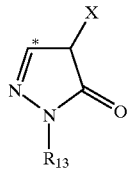

(I-1C)

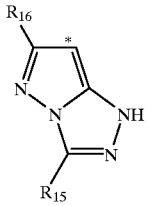

-continued (I-2C)

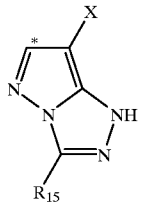

(I-1D)

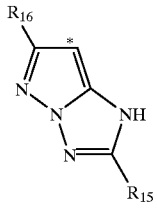

(I-2D)

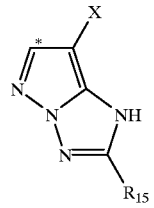

(I-1E)

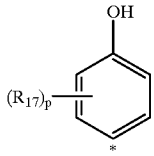

(I-2E)

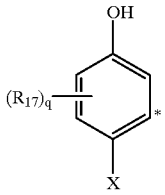

(I-1F)

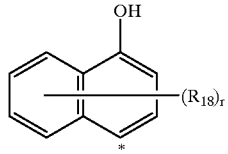

(I-2F)

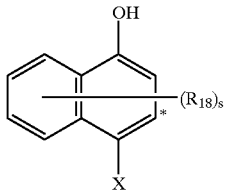

-continued (I-3F)

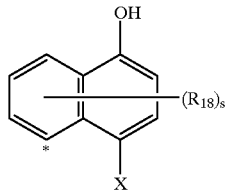

(I-1G)

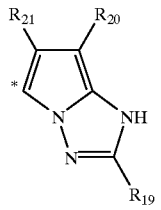

(I-2G)

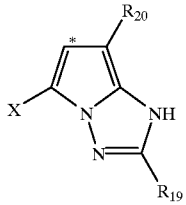

In the formulae, * represents the bonding site with connecting group A.

X represents a hydrogen atom, a halogen atom (for example, fluorine atom, chlorine atom, bromine atom or iodine atom), $R_{31}$—, $R_{31}O$—, $R_{31}S$—, $R_{31}OCOO$—, $R_{32}COO$—, $R_{32}(R_{33})NCOO$— or $R_{32}CON(R_{33})$—, and Y represents an oxygen atom, a sulfur atom, $R_{32}N$= or $R_{32}ON$=.

Herein, $R_{31}$ represents an aliphatic group (the aliphatic group defines saturated and unsaturated, chain and cyclic, linear and branched, substituted and unsubstituted aliphatic hydrocarbon groups; this definition applies hereinafter), an aryl group or a heterocyclic group.

The aliphatic group represented by $R_{31}$ is preferably an aliphatic group having 1 to 32 carbon atoms, more preferably 1 to 22 carbon atoms, which is, for example, methyl, ethyl, vinyl, ethynyl, propyl, isopropyl, 2-propenyl, 2-propynyl, butyl, isobutyl, t-butyl, t-amyl, hexyl, cyclohexyl, 2-ethylhexyl, octyl, 1,1,3,3-tetramethylbutyl, decyl, dodecyl, hexadecyl or octadecyl. The aryl group represented by $R_{31}$ is preferably a substituted or unsubstituted aryl group having 6 to 32 carbon atoms, more preferably 6 to 22 carbon atoms, which is, for example, phenyl, tolyl or naphthyl. The heterocyclic group represented by $R_{31}$ is preferably a substituted or unsubstituted heterocyclic group having 1 to 32 carbon atoms, more preferably 1 to 22 carbon atoms, which is, for example, 2-furyl, 2-pyrrolyl, 2-thienyl, 3-tetrahydrofuranyl, 4-pyridyl, 2-pyrimidinyl, 2-(1,3,4-thiadiazolyl), 2-benzothiazolyl, 2-benzoxazolyl, 2-benzimidazolyl, 2-benzoselenazolyl, 2-quinolyl, 2-oxazolyl, 2-thiazolyl, 2-selenazolyl, 5-tetrazolyl, 2-(1,3,4-oxadiazolyl) or 2-imidazolyl.

Each of $R_{32}$ and $R_{33}$ independently represents a hydrogen atom, an aliphatic group, an aryl group or a heterocyclic group. The aliphatic group, aryl group and heterocyclic group represented by $R_{32}$ and $R_{33}$ have the same meaning as those of $R_{31}$, respectively.

It is preferred that X represent a hydrogen atom, an aliphatic group, an aliphatic oxy group, an aliphatic thio group or $R_{32}CON(R_{33})$— and Y represent an oxygen atom.

The substituents suitable to the above or below mentioned groups and the below mentioned substituents include, for example, halogen atoms (for example, fluorine, chlorine, bromine and iodine atoms), a hydroxyl group, a carboxyl group, a sulfo group, a cyano group, a nitro group, alkyl groups (for example, methyl, ethyl and hexyl), fluoroalkyl groups (for example, trifluoromethyl), aryl groups (for example, phenyl, tolyl and naphthyl), heterocyclic groups (for example, heterocyclic groups mentioned with respect to $R_{31}$), alkoxy groups (for example, methoxy, ethoxy and octyloxy), aryloxy groups (for example, phenoxy and naphthyloxy), alkylthio groups (for example, methylthio and butylthio), arylthio groups (for example, phenylthio), amino groups (for example, amino, N-methylamino, N,N-dimethylamino and N-phenylamino), acyl groups (for example, acetyl, propionyl and benzoyl), alkyl- or arylsulfonyl groups (for example, methylsulfonyl and phenylsulfonyl), acylamino groups (for example, acetylamino and benzoylamino), alkyl- or arylsulfonylamino groups (for example, methanesulfonylamino and benzenesulfonylamino), carbamoyl groups (for example, carbamoyl, N-methylaminocarbonyl, N,N-dimethylaminocarbonyl and N-phenylaminocarbonyl), sulfamoyl groups (for example, sulfamoyl, N-methylaminosulfonyl, N,N-dimethylaminosulfonyl and N-phenylaminosulfonyl), alkoxycarbonyl groups (for example, methoxycarbonyl, ethoxycarbonyl and octyloxycarbonyl), aryloxycarbonyl groups (for example, phenoxycarbonyl and naphthyloxycarbonyl), acyloxy groups (for example, acetyloxy and benzoyloxy), alkoxycarbonyloxy groups (for example, methoxycarbonyloxy and ethoxycarbonyloxy), aryloxycarbonyloxy groups (for example, phenoxycarbonyloxy), alkoxycarbonylamino groups (for example, methoxycarbonylamino and butoxycarbonylamino), aryloxycarbonylamino groups (for example, phenoxycarbonylamino), aminocarbonyloxy groups (for example, N-methylaminocarbonyloxy and N-phenylaminocarbonyloxy) and aminocarbonylamino groups (for example, N-methylaminocarbonylamino and N-phenylaminocarbonylamino).

Each of $R_{11}$ and $R_{12}$ independently represents $R_{32}CO$—, $R_{31}OCO$—, $R_{32}(R_{33})NCO$—, $R_{31}SO_n$—, $R_{32}(R_{33})NSO_2$— or a cyano group. These $R_{31}$, $R_{32}$ and $R_{33}$ are as defined above, and n is 1 or 2.

$R_{13}$ represents the same group as defined by the above $R_{31}$.

$R_{14}$ represents $R_{32}$—, $R_{32}CON(R_{33})$—, $R_{32}(R_{33})N$—, $R_{31}SO_2N(R_{32})$—, $R_{31}S$—, $R_{31}O$—, $R_{31}OCON(R_{32})$—, $R_{32}(R_{33})NCON(R_{34})$—, $R_{31}OCO$—, $R_{32}(R_{33})NCO$— or a cyano group. These $R_{31}$, $R_{32}$ and $R_{33}$ are as defined above, and $R_{34}$ represents the same group as defined by the above $R_{32}$. Each of $R_{15}$ and $R_{16}$ independently represents a substituent and preferably represents $R_{32}$—, $R_{32}CON(R_{33})$—, $R_{31}SO_2N(R_{32})$—, $R_{31}S$—, $R_{31}O$—, $R_{31}OCON(R_{32})$—, $R_{32}(R_{33})NCON(R_{34})$—, $R_{31}OCO$—, $R_{32}(R_{33})NCO$—, a halogen atom or a cyano group. More preferably, each of $R_{15}$ and $R_{16}$ represents the same group as represented by $R_{31}$. These $R_{31}$, $R_{32}$, $R_{33}$ and $R_{34}$ are as defined above.

$R_{17}$ represents a substituent, p is an integer of 0 to 4, and q is an integer of 0 to 3. Preferred substituents represented by $R_{17}$ include $R_{31}$—, $R_{32}CON(R_{33})$—, $R_{31}OCON(R_{32})$—, $R_{31}SO_2N(R_{32})$—, $R_{32}(R_{33})NCON(R_{34})$—, $R_{31}S$—, $R_{31}O$— and halogen atoms. These $R_{31}$, $R_{32}$, $R_{33}$ and $R_{34}$ are as defined above. When each of p and q is 2 or greater, the groups $R_{17}$ may be identical with each other or different from each other. Adjacent groups $R_{17}$ may be bonded with each other to thereby effect a cyclization. In preferred forms of the general formulae (I-1E) and (I-2E), at least one ortho position to the hydroxyl group is substituted with $R_{32}CONH$—, $R_{31}OCONH$— or $R_{32}(R_{33})NCONH$—.

$R_{18}$ represents a substituent, r is an integer of 0 to 6, and s is an integer of 0 to 5. Preferred groups represented by $R_{18}$ include $R_{32}CON(R_{33})$—, $R_{31}OCON(R_{32})$—, $R_{31}SO_2N$ $(R_{32})$—, $R_{32}(R_{33})NCON(R_{34})$—, $R_{31}S$—, $R_{31}O$—, $R_{32}(R_{33})NCO$—, $R_{32}(R_{33})NSO_2$—, $R_{31}OCO$—, a cyano group and a halogen atom (for example, a fluorine atom, a chlorine atom, a bromine atom and an iodine atom). These $R_{31}$, $R_{32}$, $R_{33}$ and $R_{34}$ are as defined above. When each of r and s is 2 or greater, the groups $R_{18}$ may be identical with each other or different from each other. Adjacent groups $R_{18}$ may be bonded with each other to thereby effect a cyclization. In preferred forms of the general formulae (I-1F), (I-2F) and (I-3F), the ortho position to the hydroxyl group is substituted with $R_{32}CONH$—, $R_{32}HNCONH$—, $R_{32}(R_{33})NSO_2$— or $R_{32}NHCO$—.

$R_{19}$ represents a substituent and preferably represents $R_{32}$—, $R_{32}CON(R_{33})$—, $R_{31}SO_2N(R_{53})$—, $R_{31}S$—, $R_{31}O$—, $R_{31}OCON(R_{32})$—, $R_{32}(R_{33})NCON(R_{34})$—, $R_{31}OCO$—, $R_{32}(R_{33})NSO_2$—, $R_{32}(R_{33})NCO$—, a halogen atom (for example, a fluorine atom, a chlorine atom, a bromine atom or an iodine atom) or a cyano group. More preferably, $R_{19}$ represents the same group as represented by $R_{32}$. These $R_{31}$, $R_{32}$, $R_{33}$ and $R_{34}$ are as defined above.

Each of $R_{20}$ and $R_{21}$ independently represents a substituent and preferably represents $R_{32}$—, $R_{32}CON(R_{33})$—, $R_{31}SO_2N(R_{32})$—, $R_{31}S$—, $R_{31}O$—, $R_{31}OCON(R_{32})$—, $R_{32}(R_{33})NCON(R_{34})$—, $R_{32}(R_{33})NCO$—, $R_{32}(R_{33})NSO_2$—, $R_{31}OCO$—, a halogen atom (for example, a fluorine atom, a chlorine atom, a bromine atom or an iodine atom) or a cyano group. More preferably, each of $R_{20}$ and $R_{21}$ represents $R_{32}(R_{33})NCO$—, $R_{32}(R_{33})NSO_2$—, a trifluoromethyl group, $R_{31}OCO$— or a cyano group. These $R_{31}$, $R_{32}$, $R_{33}$ and $R_{34}$ are as defined above.

E represents an electrophilic group such as —CO—, —CS—, —COCO—, —SO—, —$SO_2$—, —P(=O)($R_{51}$)— or —P(=S)($R_{51}$)— {$R_{51}$ represents an aliphatic group, an aryl group, an aliphatic oxy group, an aryloxy group, an aliphatic thio group or an arylthio group}, or represents —C($R_{52}$)($R_{53}$) {each of $R_{52}$ and $R_{53}$ represents a hydrogen atom, an aliphatic group, an aryl group or a heterocyclic group, wherein the aliphatic group, aryl group and heterocyclic group have the same meaning as described with respect to $R_{31}$}. E preferably represents —CO—.

A represents a connecting group which can release B while forming a (preferably 4 to 8-membered, more preferably 5 to 7-membered, and most preferably 6-membered) ring through an intramolecular nucleophilic substitution reaction between the electrophilic moiety E and the nitrogen atom of a coupling product of COUP and a developing agent oxidation product, the nitrogen atom attributed to the developing agent.

Examples of the connecting groups represented by A include:

x—$(CO)_{n1}$—$(Y')_{n2}$—$\{C(R_{41})(R_{42})\}_{n4}$—xx, x—$(CO)_{n1}$—$\{N(R_{43})\}_{n3}$—$\{C(R_{41})(R_{42})\}_{n4}$—xx, x—$(Y')_{n2}$—$(CO)_{n1}$—$\{C(R_{41})(R_{42})\}_{n4}$—xx, x—$\{N(R_{43})\}_{n3}$—$(CO)_{n1}$—$\{C(R_{41})(R_{42})\}_{n4}$—xx, x—$(CO)_{n1}$—$\{C(R_{41})(R_{42})\}_{n4}$—$(Y')_{n2}$—xx, x—$(CO)_{n1}$—$\{C(R_{41})(R_{42})\}_{n4}$—$\{N(R_{43})\}_{n3}$—xx, x—$(Y')_{n2}$—xx, and x-$\{N(R_{43})\}_{n3}$—xx.

In the above formulae, x represents a site at which the connecting group is bonded with COUP, and xx represents a site at which the connecting group is bonded with E. Y' represents an oxygen atom or a sulfur atom. Each of $R_{41}$, $R_{42}$ and $R_{43}$ represents a hydrogen atom, an aliphatic group, an aryl group or a heterocyclic group (the aliphatic group, aryl group and heterocyclic group have the same meaning as described with respect to $R_{31}$), provided that two of $R_{41}$, $R_{42}$ and $R_{43}$ may be bonded with each other or each of $R_{41}$, $R_{42}$ and $R_{43}$ may be bonded with COUP, so as to form a ring.

Each of n1 and n3 is an integer of 0 to 2, n2 is 0 or 1, and n4 is an integer of 1 to 5 (when n3 and n4 are an integer of 2 or more, relevant $N(R_{43})$ moieties as well as $C(R_{41})(R_{42})$ moieties may be identical with or different from each other). Further, n1+n2+n4, n1+n3+n4, n2, and n3 are so selected that a 4 to 8-membered ring is formed through an intramolecular nucleophilic substitution reaction between the electrophilic moiety E and the nitrogen atom of a coupling product of COUP and a developing agent oxidation product, the nitrogen atom attributed to the developing agent and directly bonded to the coupling position. Provided, however, that when —$N(R_{43})$— is directly bonded with E, $R_{43}$ is not a hydrogen atom, and that when the connecting group A is connected to COUP at the coupling position thereof, the part directly connected to COUP is not —Y'—.

Although the position at which COUP is bonded with the connecting group A is not limited as long as B can be released while forming a (preferably 4 to 8-membered, more preferably 5 to 7-membered, and most preferably 6-membered) ring through an intramolecular nucleophilic substitution reaction between the electrophilic moiety E and the nitrogen atom of a coupling product of COUP and a developing agent oxidation product, the nitrogen atom attributed to the developing agent, it is preferred that the position be the coupling position of COUP or position vicinal thereto, i.e., the atom adjacent to the coupling position or the atom adjacent to that adjacent atom.

When the connecting group A is bonded to the coupling position (1), or the atom adjacent to the coupling position (2), or the atom adjacent to the atom adjacent to the coupling position (3), of the coupler residue represented by COUP, the coupler of the present invention and the reaction between the coupler of the present invention and an oxidation product, i.e., Ar'=NH, of an aromatic amine developing agent represented by the formula: $ArNH_2$ can be expressed by the following formulae.

1) The case where A bonds to the coupling position of COUP

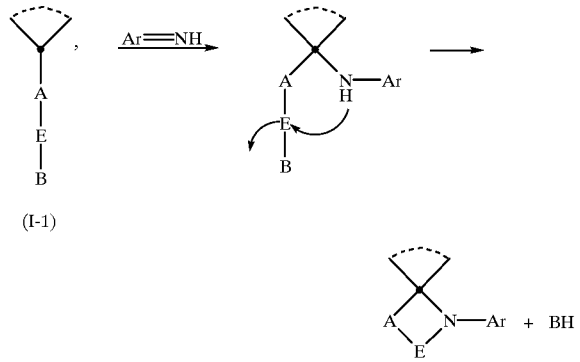

2) The case where A bonds to the atom adjacent to the coupling position of COUP

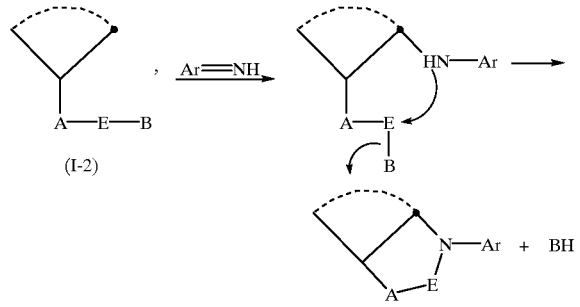

3) The case where A bonds to the atom adjacent to the adjacent atom of the coupling position of COUP

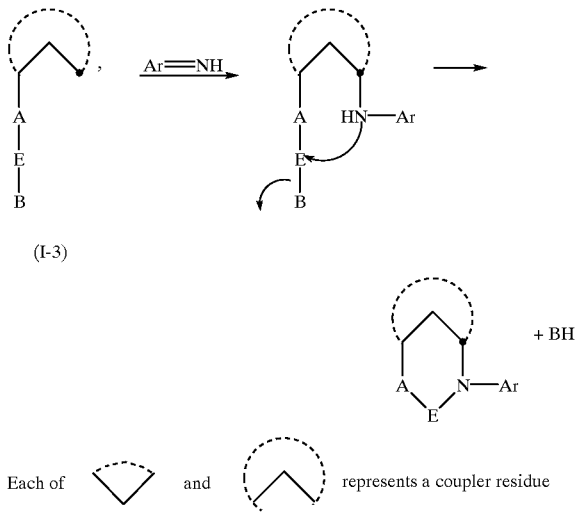

(I-3)

capable of coupling with a developer in an oxidized form, which is not necessarily a circular structure. The mark, ., represents the coupling position. The linear part, —, represents a bonding between non-metalic atoms.

Examples of the connecting groups A preferably used in the general formula (I-1) {wherein COUP is preferably represented by the formula (I-1A), (I-1B), (I-1C), (I-1D), (I-1E), (I-1F) or (I-1G)} include:

x—CO—C($R_{41}$)($R_{42}$)—C($R_{41}$)($R_{42}$)—xx, x—C($R_{41}$)($R_{42}$)—C($R_{41}$)($R_{42}$)—xx, x—C($R_{41}$)($R_{42}$)—C($R_{41}$)($R_{42}$)—C($R_{41}$)($R_{42}$)—xx, x—C($R_{41}$)($R_{42}$)—N($R_{43}$)—xx, x—C($R_{41}$)($R_{42}$)—C($R_{41}$)($R_{42}$)—O—xx, x—C($R_{41}$)($R_{42}$)—C($R_{41}$)($R_{42}$)—S—xx, and x—C($R_{41}$)($R_{42}$)—C($R_{41}$)($R_{42}$)—N($R_{43}$)—xx.

More preferred examples thereof are:

x—C($R_{41}$)($R_{42}$)—N($R_{43}$)—xx, x—C($R_{41}$)($R_{42}$)—C($R_{41}$)($R_{42}$)—O—xx, and x—C($R_{41}$)($R_{42}$)—C($R_{41}$)($R_{42}$)—N($R_{43}$)—xx.

In the above formulae, x, xx, $R_{41}$, $R_{42}$ and $R_{43}$ are as defined above (when at least two —C($R_{41}$)($R_{42}$)— groups are present in one connecting group, relevant $R_{41}$ moieties as well as $R_{42}$ moieties may be identical with or different from each other).

Examples of the connecting groups A preferably used in the general formula (I-2) {wherein COUP is preferably represented by the formula (I-2A), (I-2B), (I-2C), (I-2D), (I-2E), (I-2F) or (I-2G)} include:

x—C($R_{41}$)($R_{42}$)—xx, x—C($R_{41}$)($R_{42}$)—C($R_{41}$)($R_{42}$)—xx, x—O—xx, x—S—xx, x—N($R_{43}$)—xx, x—C($R_{41}$)($R_{42}$)—O—xx, x—C($R_{41}$)($R_{42}$)—S—xx, and x—C($R_{41}$)($R_{42}$)—N($R_{43}$)—xx.

More preferred examples thereof are:

x—O—xx, x—N($R_{43}$)—xx, x—C($R_{41}$)($R_{42}$)—O—xx, and x—C($R_{41}$)($R_{42}$)—N($R_{43}$)—xx.

In the above formulae, x, xx, $R_{41}$, $R_{42}$ and $R_{43}$ are as defined above (when at least two —C($R_{41}$)($R_{42}$)— groups are present in one connecting group, relevant $R_{41}$ moieties as well as $R_{42}$ moieties may be identical with or different from each other).

Examples of the connecting groups A preferably used in the general formula (I-3) {wherein COUP is preferably represented by the formula (I-3F)} include x—C($R_{41}$)($R_{42}$)—xx, x—O—xx, x–S—xx, and x—N($R_{43}$)—xx. More preferred examples thereof are x—O—xx and x—N($R_{43}$)—xx. Most preferred examples thereof are x—N($R_{43}$)—xx. In the formulae, x, xx, $R_{41}$, $R_{42}$ and $R_{43}$ are as defined above.

B represents a photographically inert group which can be released through, after a coupling reaction of COUP with an oxidation product of developing agent to form the coupling product, an intramolecular nucleophilic substitution reaction with the nitrogen atom of the coupling product, wherein the nitrogen atom originates from the developing agent and directly bonds to the coupling position of COUP. The terminology "photographically inert" used herein means that released $B^-$ (or BH) substantially does not contribute to color image formation and further exerts substantially no influence on the development speed or the velocity of coupling between an oxidation product of developing agent and a color forming coupler. With respect to B, the pKa value of its conjugate acid (BH) is preferably 13 or below, more preferably 11 or below.

B represents, for example, any of an aryloxy group having 6 to 32 carbon atoms, a heterocyclic oxy group having 1 to 32 carbon atoms, and whose cyclic group has preferably 3 to 8 members, more preferably 5 or 6 members, an aliphatic thio group having 1 to 32 carbon atoms, an arylthio group having 6 to 32 carbon atoms, a heterocyclic thio group having 1 to 32 carbon atoms, and whose cyclic group has preferably 3 to 8 members, more preferably 5 or 6 members and a heterocyclic group containing nitrogen bonded at its nitrogen atom to the electrophilic moiety E and having 2 to 32 carbon atoms, and whose cyclic group has preferably 3 to 8 members, more preferably 5 or 6 members.

Of these, most preferred groups B are, for example, as follows:

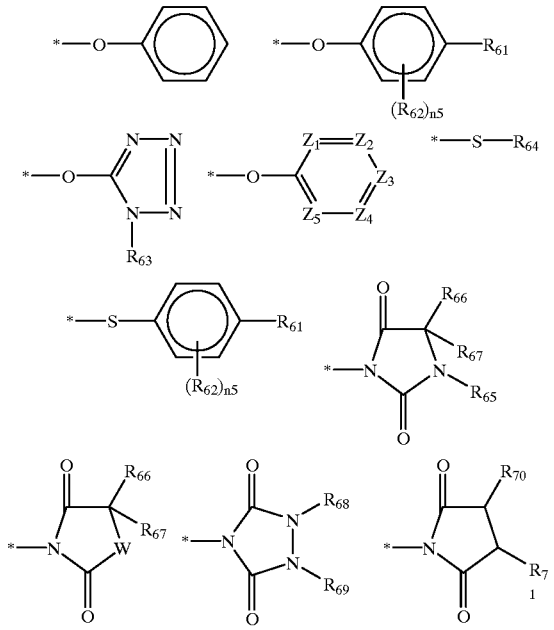

In the above formulae, * represents the position at which the group is bonded to E.

$R_{61}$ represents a nitro group, a cyano group, a trifluoromethyl group, a carboxyl group, a sulfo group, an aliphatic group having 1 to 32, preferably 1 to 22, carbon atoms (for example, methyl, ethyl, butyl or octadecyl), a substituted or unsubstituted aryl group having 6 to 32, preferably 6 to 22, carbon atoms (for example, phenyl, naphthyl or p-hexadecyloxyphenyl), a carbamoyl group having 1 to 32, preferably 1 to 22, carbon atoms (for example, methylcarbamoyl, ethylcarbamoyl, octylcarbamoyl or dioctylcarbamoyl), a sulfamoyl group having 1 to 32, preferably 1 to 22, carbon atoms (for example, methylsulfamoyl, ethylsulfamoyl or dodedylsulfamoyl), an alkoxycarbonyl group having 2 to 33, preferably 2 to 22, carbon atoms (for example, methoxycarbonyl, ethoxycarbonyl, butoxycarbonyl or hexadecyloxycarbonyl), an acylamino group having 1 to 32, preferably 1 to 22, carbon atoms (for example, acetylamino or benzoylamino), or an alkylsulfonyl group having 1 to 32, preferably 1 to 22, carbon atoms or arylsulfonyl group having 6 to 32, preferably 6 to 22, carbon atoms (for example, methylsulfonyl, butylsulfonyl, dodecylsulfonyl or phenylsulfonyl).

$R_{62}$ represents a halogen atom (for example, a fluorine atom, a chlorine atom or a bromine atom), a nitro group, a cyano group, a trifluoromethyl group, a carboxyl group, a sulfo group, an aliphatic group having 1 to 32, preferably 1 to 22, carbon atoms (for example, methyl, ethyl, butyl or octadecyl), a substituted or unsubstituted aryl group having 6 to 32, preferably 6 to 22, carbon atoms (for example, phenyl, naphthyl or p-hexadecyloxyphenyl), a carbamoyl group having 1 to 32, preferably 1 to 22, carbon atoms (for example, methylcarbamoyl, ethylcarbamoyl, octylcarbamoyl or dioctylcarbamoyl), a sulfamoyl group having 1 to 32, preferably 1 to 22, carbon atoms (for example, methylsulfamoyl, ethylsulfamoyl or dodedylsulfamoyl), an alkoxycarbonyl group having 2 to 32, preferably 2 to 22, carbon atoms (for example, methoxycarbonyl, ethoxycarbonyl, butoxycarbonyl or hexadecyloxycarbonyl), an acylamino group having 1 to 32, preferably 1 to 22, carbon atoms (for example, acetylamino or benzoylamino), an alkylsulfonyl group having 1 to 32, preferably 1 to 22, carbon atoms or arylsulfonyl group having 6 to 32, preferably 6 to 22, carbon atoms (for example, methylsulfonyl, butylsulfonyl, dodecylsulfonyl or phenylsulfonyl), an alkoxy group having 1 to 32, preferably 1 to 22, carbon atoms (for example, methoxy, ethoxy, isopropoxy or octadecyloxy) or an aryloxy group having 6 to 32, preferably 6 to 22, carbon atoms (for example, phenoxy or naphthyloxy). n5 is an integer of 0 to 4. When n5 is 2 or greater, a plurality of groups $R_{62}$ may be identical with or different from each other.

$R_{63}$ represents an aliphatic group, an aryl group or a heterocyclic group (the aliphatic group, aryl group and heterocyclic group have the same meaning as described with respect to $R_{31}$).

Each of $Z_1$, $Z_2$, $Z_4$ and $Z_5$ independently represents CH, $C(R_{62})$ or a nitrogen atom, and $Z_3$ represents CH, $C(R_{61})$ or a nitrogen atom, provided that at least one of $Z_1$, $Z_2$, $Z_3$, $Z_4$ and $Z_5$ represents a nitrogen atom.

$R_{64}$ represents an aliphatic group having 1 to 32 carbon atoms, unsubstituted or substituted with a halogen atom (for example, a fluorine atom, a chlorine atom or a bromine atom). Example or $R_{64}$ are methyl, ethyl, butyl and chloroethyl.

$R_{65}$ represents a hydrogen atom, an aliphatic group having 1 to 32, preferably 1 to 22, carbon atoms (for example, methyl, ethyl, benzyl or octyl) or an acyl group having 1 to 32, preferably 1 to 22, carbon atoms (for example, acetyl or benzoyl). Preferably, $R_{65}$ represents a hydrogen atom or such an aliphatic group.

Each of $R_{66}$ and $R_{67}$ independently represents a hydrogen atom, an aliphatic group having 1 to 32, preferably 1 to 22, carbon atoms (for example, methyl, ethyl, butyl or octadecyl), a substituted or unsubstituted aryl group having 6 to 32, preferably 6 to 22, carbon atoms (for example, phenyl, naphthyl or p-hexadecyloxyphenyl), an aliphatic oxy group having 1 to 32, preferably 1 to 22, carbon atoms (for example, methoxy, ethoxy, isopropoxy or octadecyloxy), an aryloxy group having 6 to 32, preferably 6 to 22, carbon atoms (for example, phenoxy or naphthyloxy) or a hydroxyl group. W represents an oxygen atom or a sulfur atom, preferably an oxygen atom.

Each of $R_{68}$ and $R_{69}$ independently represents a hydrogen atom, an aliphatic group having 1 to 32, preferably 1 to 22, carbon atoms (for example, methyl, ethyl, benzyl or octadecyl) or an acyl group having 1 to 32, preferably 1 to 22, carbon atoms (for example, acetyl or benzoyl). Preferably, each of $R_{68}$ and $R_{69}$ represents a hydrogen atom or such an aliphatic group. $R_{68}$ and $R_{69}$ may be bonded with each other so as to form a 3- to 8-membered ring, preferably a 5- or 6-membered ring.

Each of $R_{70}$ and $R_{71}$ independently represents a hydrogen atom, an aliphatic group having 1 to 32, preferably 1 to 22, carbon atoms (for example, methyl, ethyl, butyl or octadecyl), a substituted or unsubstituted aryl group having 6 to 32, preferably 6 to 22, carbon atoms (for example, phenyl, naphthyl or p-hexadecyloxyphenyl), an aliphatic oxy group having 1 to 32, preferably 1 to 22, carbon atoms (for example, methoxy, ethoxy, isopropoxy or hexadecyloxy), an aryloxy group having 6 to 32, preferably 6 to 22, carbon atoms (for example, phenoxy or naphthyloxy) or a hydroxyl group. $R_{70}$ and $R_{71}$ may be bonded with each other so as to form a 3- to 8-membered ring, preferably a 5- or 6-membered ring.

Examples of developing agents which can be used to process the lightsensitive material of the present invention include phenylenediamine and aminophenol developing agents described in, for example, U.S. Pat. Nos. 2,193,015, 2,592,364, 5,240,821 and JP-A-48-64933, the disclosures of which are herein incorporated by reference sulfonylhydrazine developing agents described in, for example, EP Nos. 545,491 A1 and 565,165 A1, the disclosures of which are herein incorporated by reference and carbamoylhydrazine developing agents described in, for example, JP-A's-8-286340, 9-152702 and 9-211818, the disclosures of which are herein incorporated by reference. Of these, preferred use is made of p-phenylenediamine developing agents such as 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline and 3-methyl-4-amino-N-ethyl-N-β-methoxyethylaniline.

It is preferred that the trapping agent for developing agent oxidation products represented by the general formula (I) according to the present invention be nondiffusive. Thus, it is preferred that a hydrophobic group (ballast group) for imparting nondiffusiveness be arranged at one or more sites of COUP, A, E and B.

Preferred forms of the trapping agents for developing agent oxidation products represented by the general formula (I) according to the present invention are those represented by the above general formula (I-2) or (I-3), preferably the general formula (I-3) (with respect to the general formulae (I-2) and (I-3), A, E, B and preferred scopes thereof are as defined above).

With respect to the general formula (I-3), preferred form thereof is represented by the following general formula (I-3a), more preferred form thereof is represented by the following general formula (I-3b), and most preferred form thereof is represented by the following general formula (I-3c). The structure of a cyclization product obtained by a reaction between the trapping agent of the general formula (I-3c) and an oxidation product, i.e., Ar'=NH, of aromatic amine developing agent represented by $ArNH_2$ can be represented by the general formula (IV).

(I-3a)

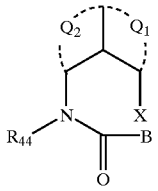

(I-3b)

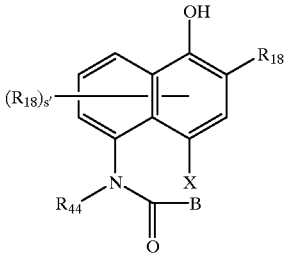

(I-3c)

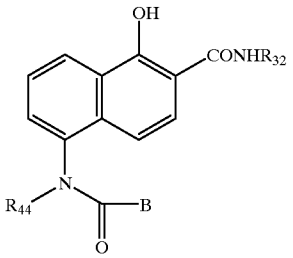

-continued (IV)

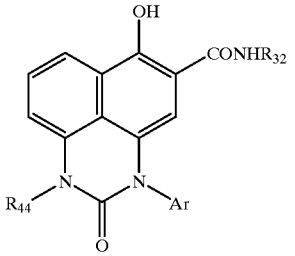

In the above formulae, each of $Q_1$ and $Q_2$ represents a nonmetallic atomic group which forms a 5- or 6-membered ring and which is required for inducing a coupling reaction with an oxidation product of developing agent by the atom of the root portion of X, and s' is an integer of 0 to 4. X, B, $R_{18}$ and $R_{32}$ are as defined above. $R_{44}$ represents an aliphatic group, an aryl group or a heterocyclic group, preferably an aliphatic group (the aliphatic group, aryl group and heterocyclic group have the same meaning as described with respect to $R_{31}$).

Specific examples of the trapping agents (hereinafter also referred to as "couplers") for developing agent oxidation products that are employed in the lightsensitive material of the present invention will be set forth below, which examples however do not limit the scope of the employable trapping agents.

(1)

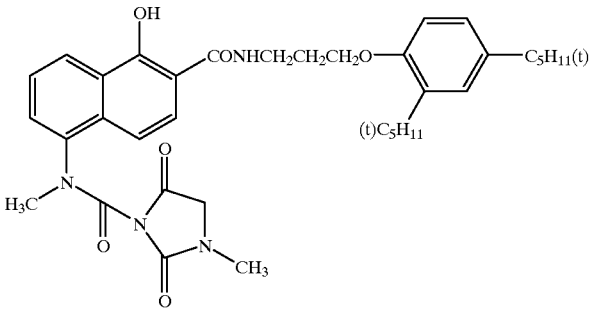

(2)

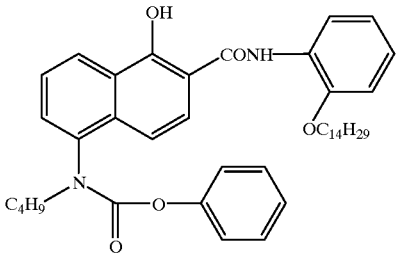

(3)

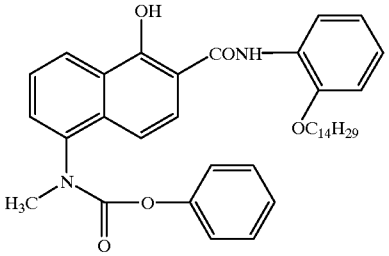

-continued
(4)
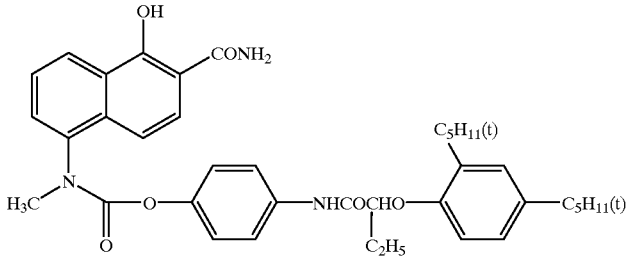
(5)
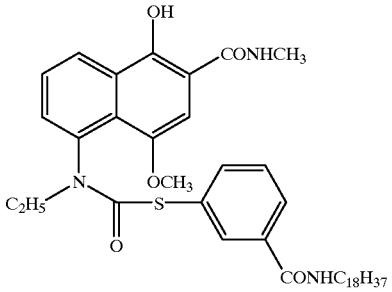
(6)
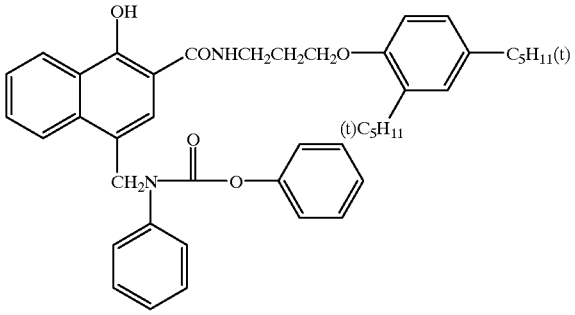
(7)
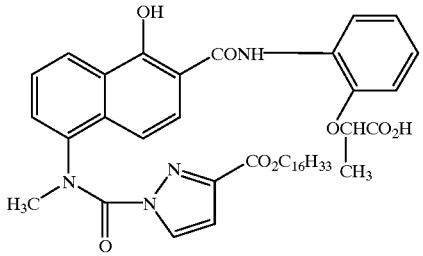
(8)
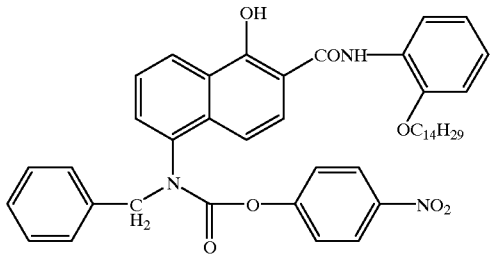
(9)
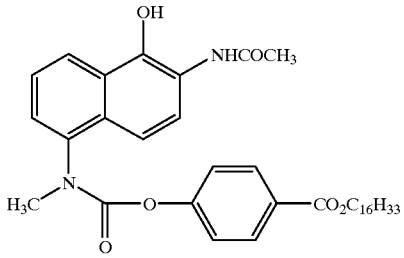
(10)
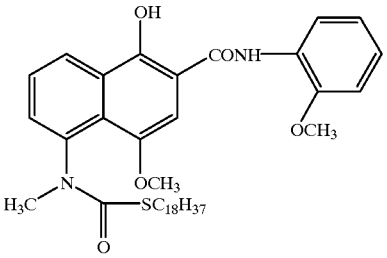
(11)
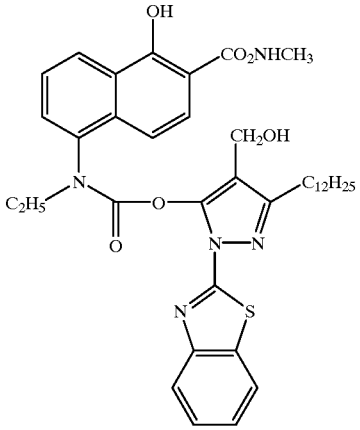
(12)
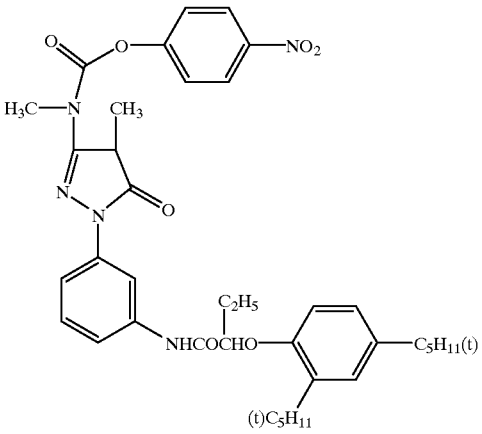

-continued
(13)
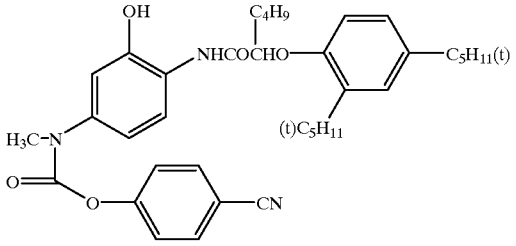
(14)
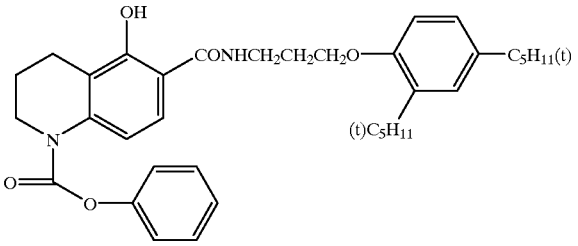
(15)
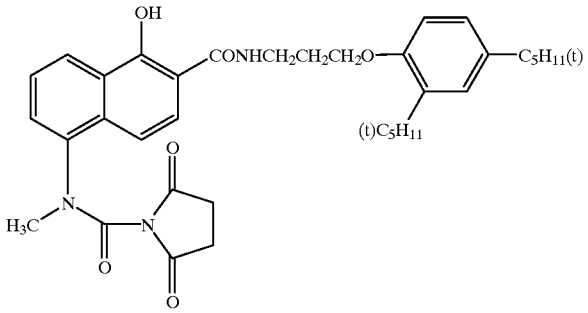
(16)
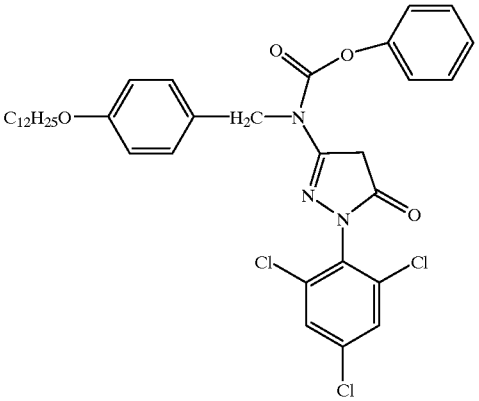
(17)
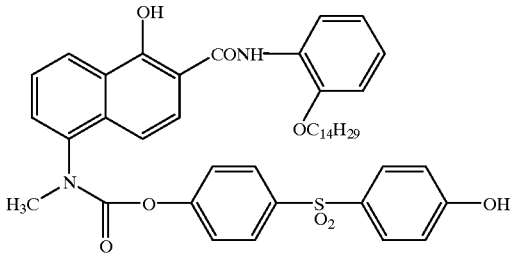
(18)
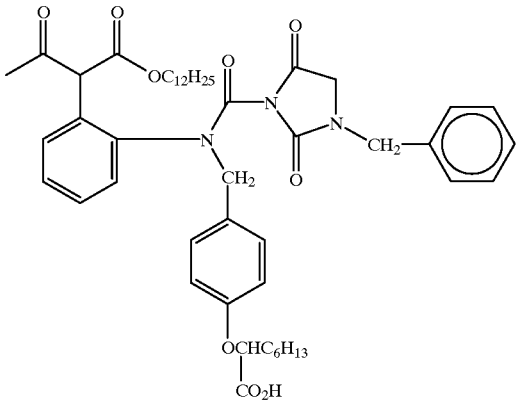
(19)
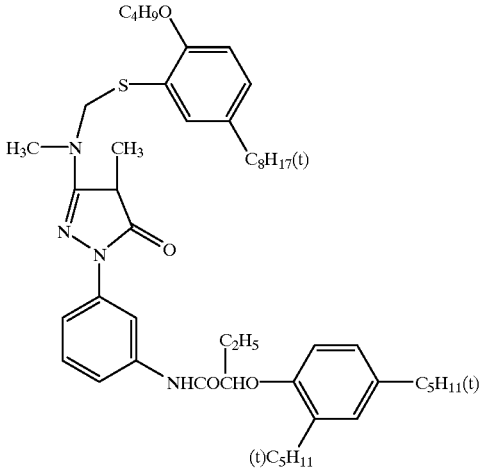
(20)
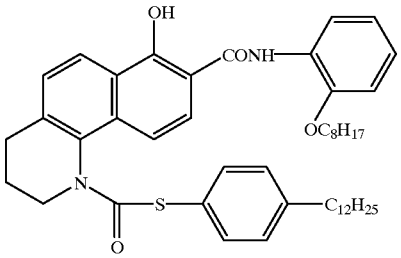

-continued
(21)
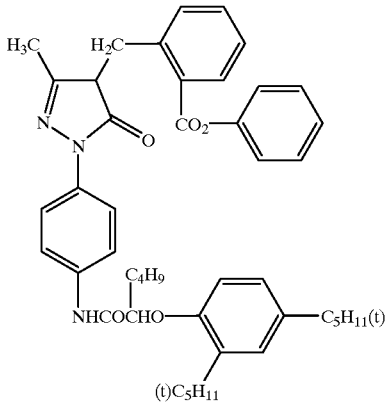
(22)
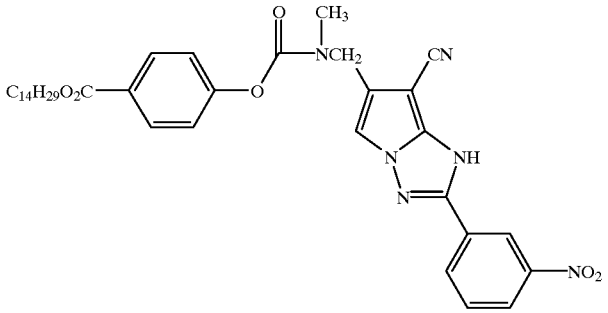
(23)
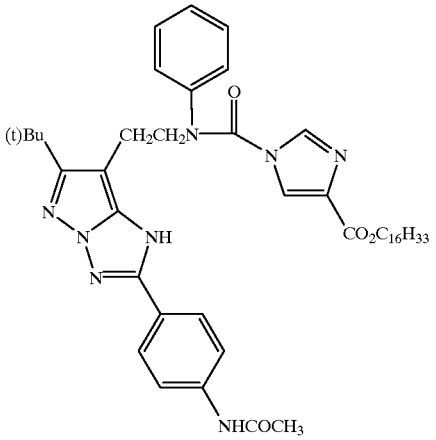
(24)
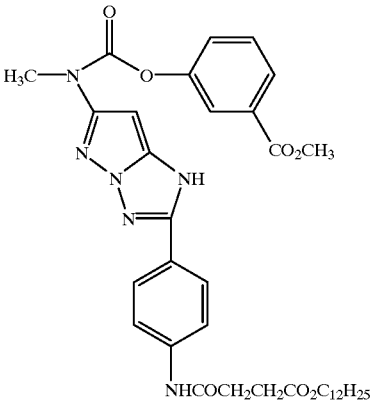

-continued
(25)
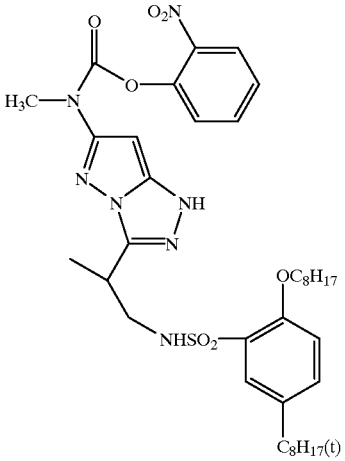
(26)
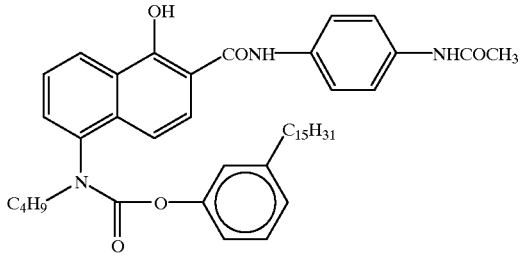
(27)
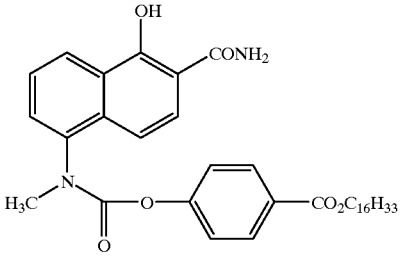
(28)
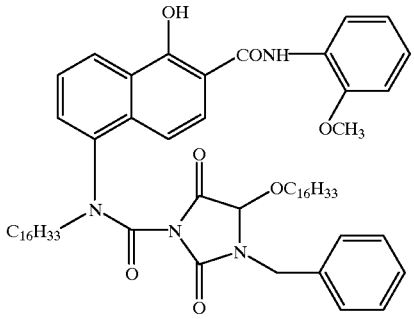
(29)
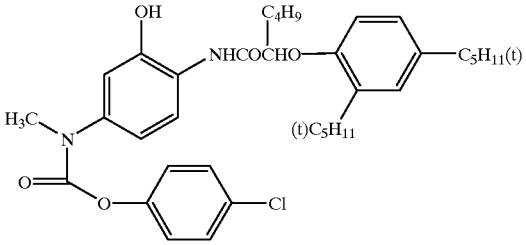
(30)
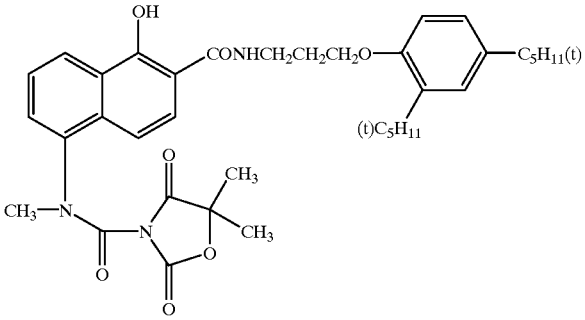
(31)
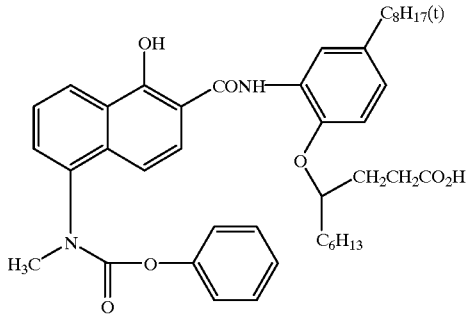

-continued
(32)
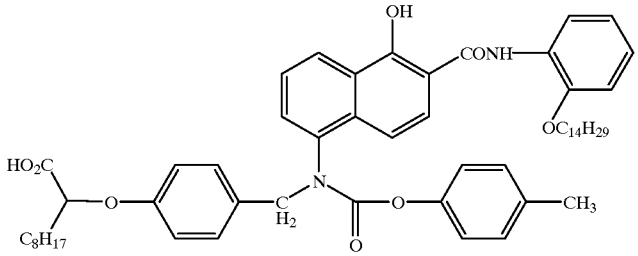
(33)
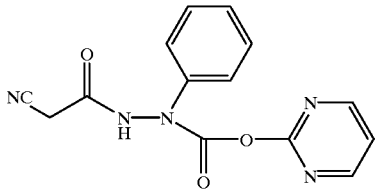
(34)
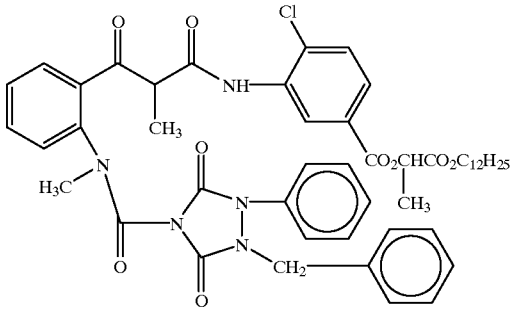
(35)
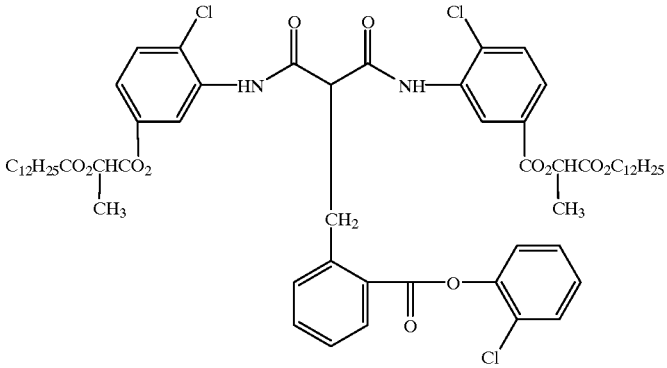
(36)
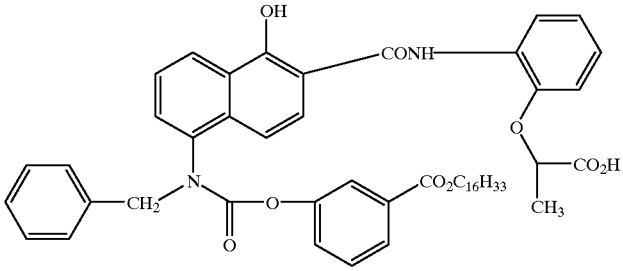
(37)
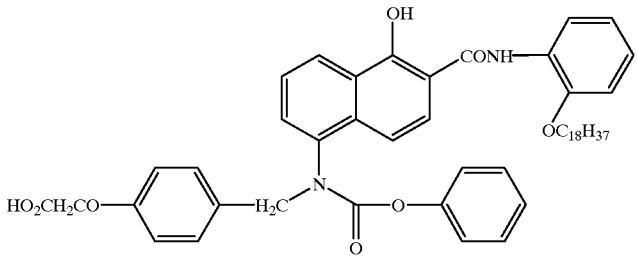

-continued
(38)
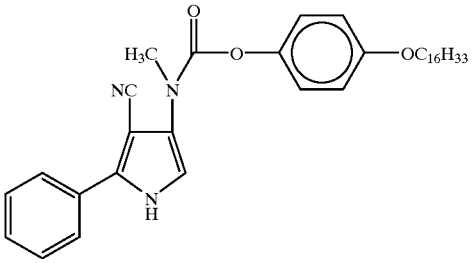
(39)
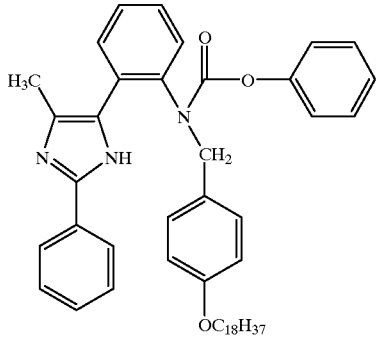
(40)
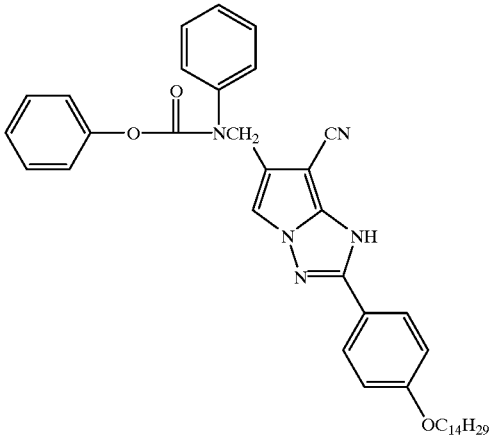
(41)
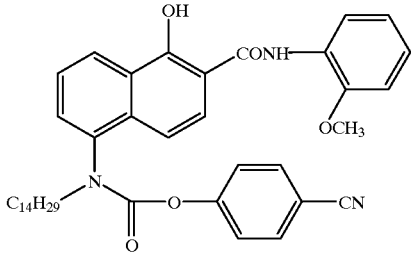
(42)
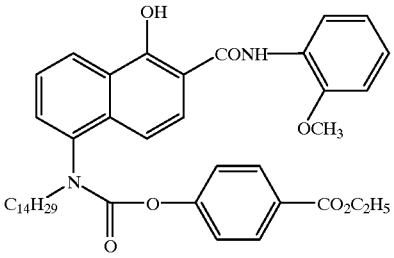
(43)
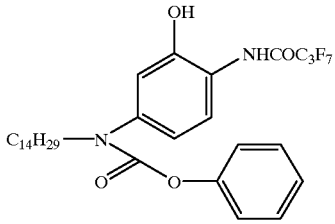
(44)
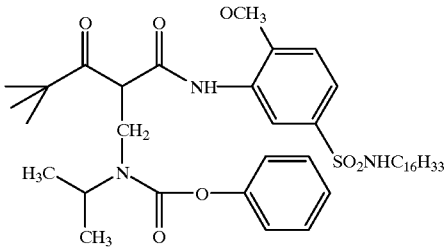
(45)
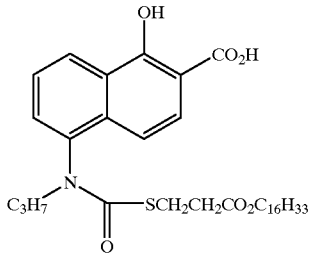
(46)
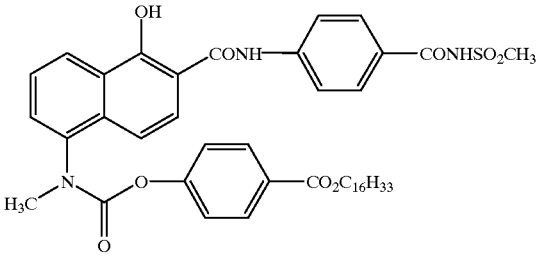
(47)
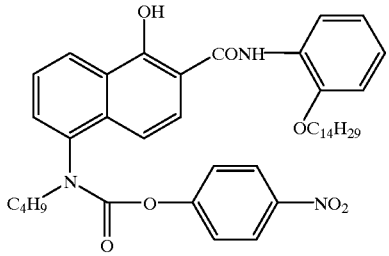

-continued
(48)
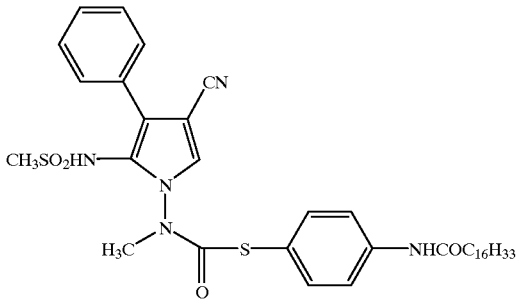
(49)
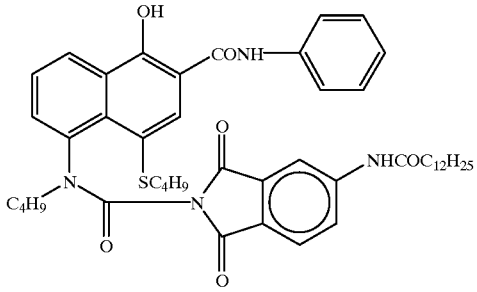
(50)
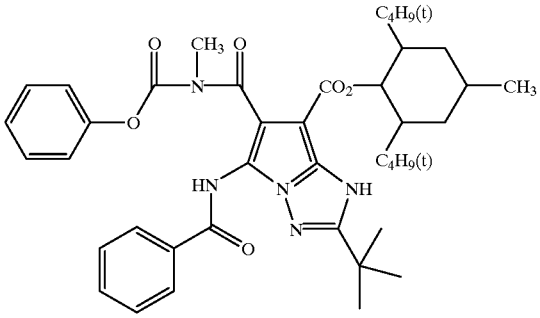
(51)
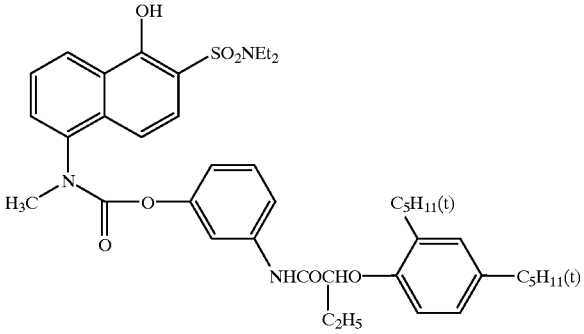
(52)
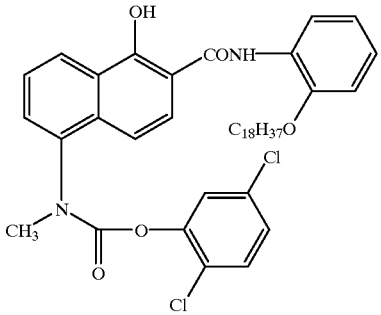
(53)
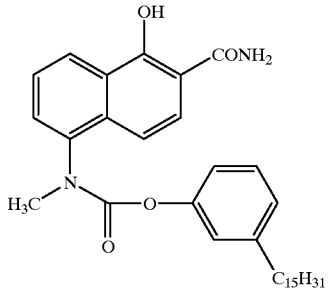
(54)
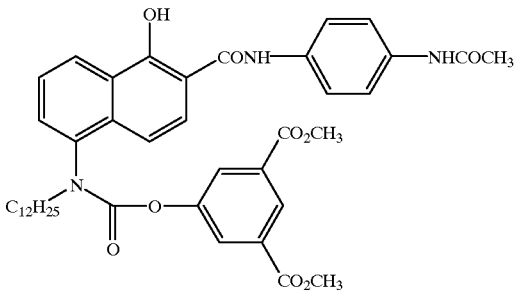
(55)
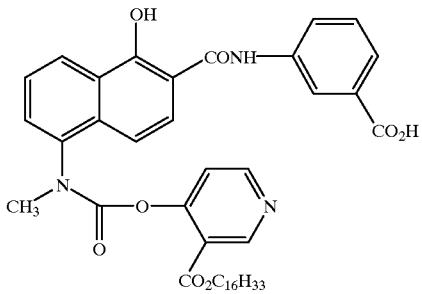

-continued
(56)
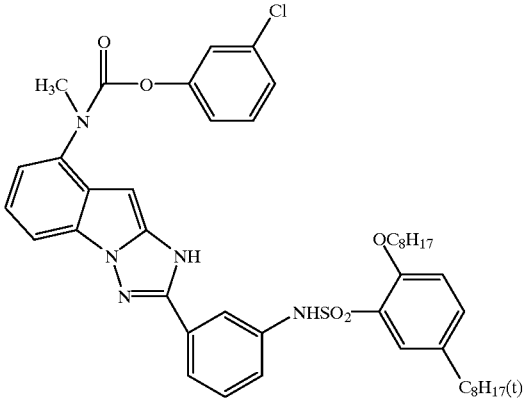
(57)
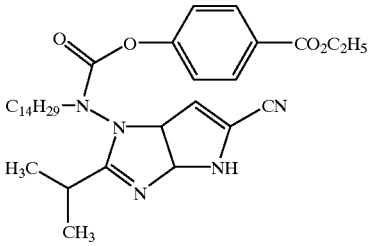
(58)
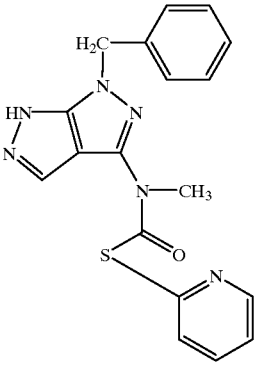
(59)
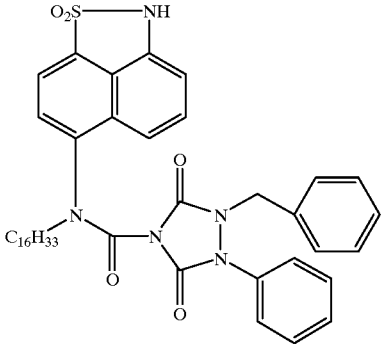
(60)
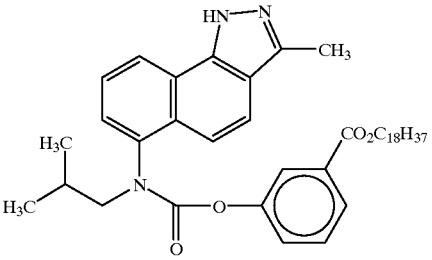
(61)
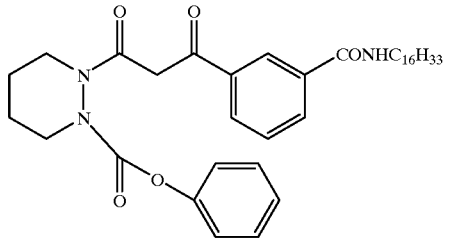
(62)
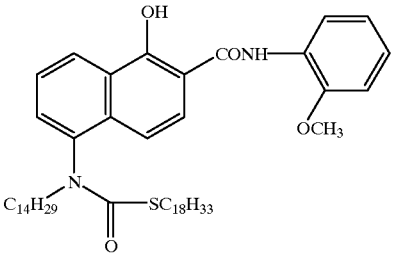
(63)
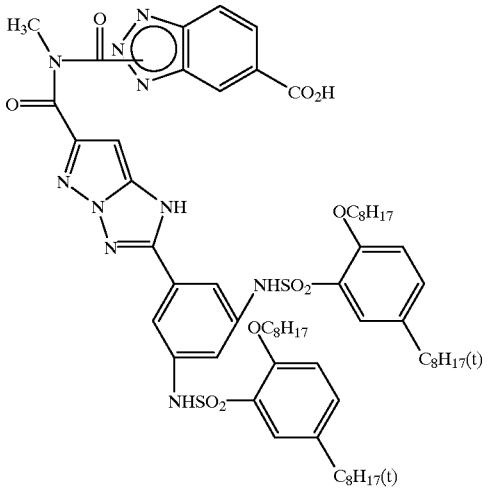

-continued
(64)
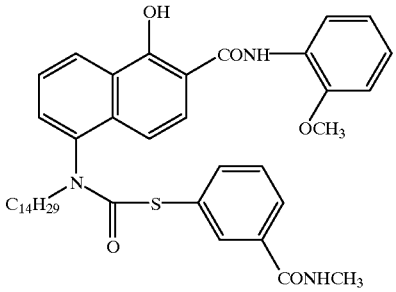
(65)
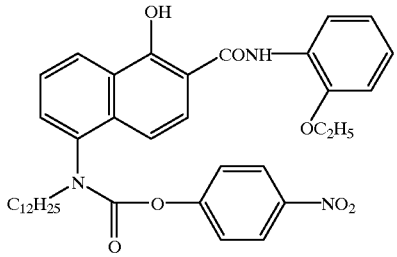
(66)
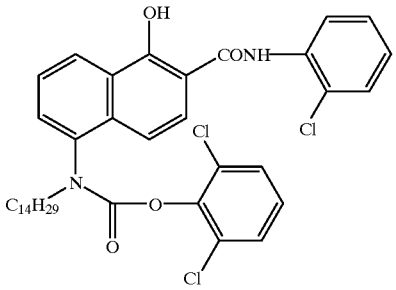
(67)
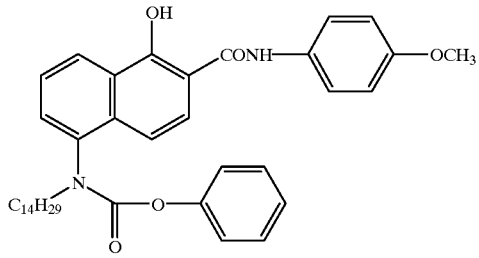
(68)
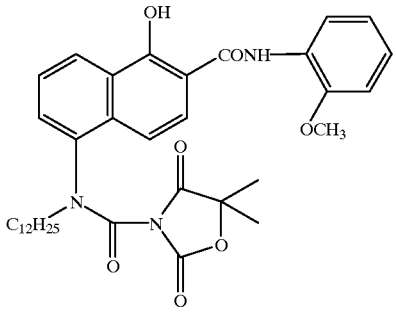
(69)
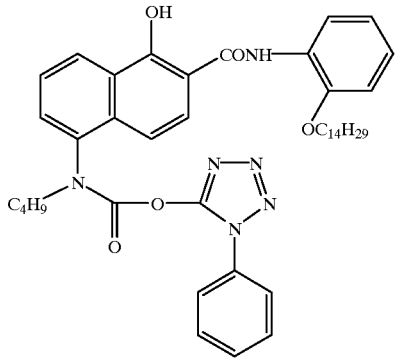
(70)
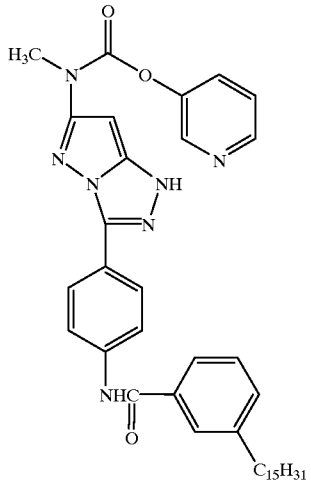
(71)
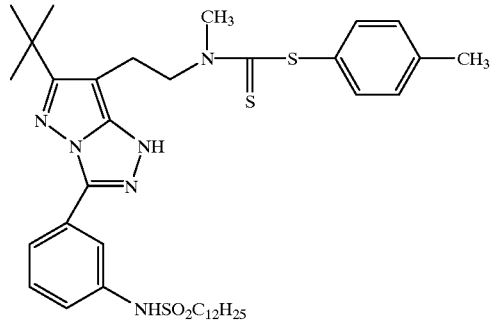

-continued
(72)
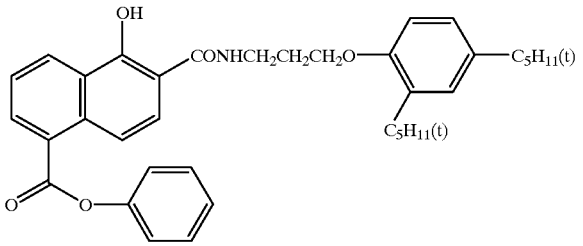
(73)
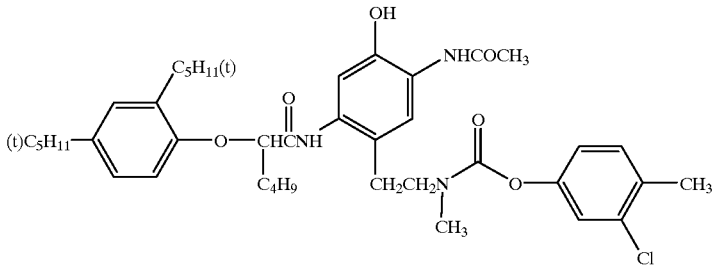
(74)
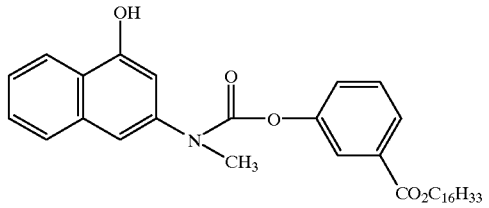
Specific examples of synthetic methods for obtaining couplers of the present invention will be described below.
<Synthesis of coupler of compound example (3)>
The coupler of compound example (3) was synthesized by the following scheme:
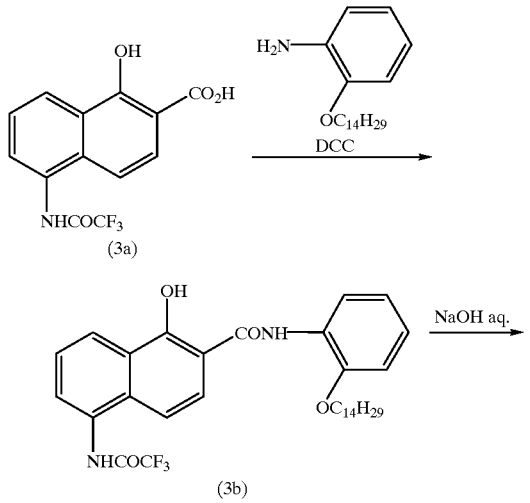
-continued
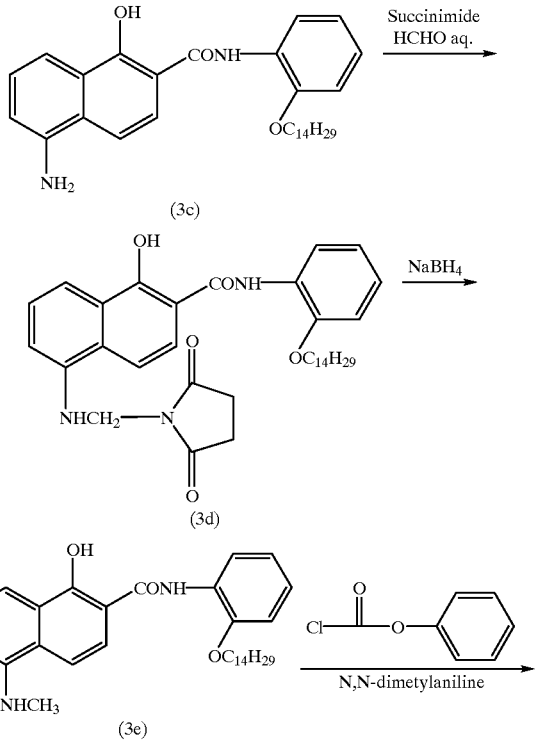

-continued

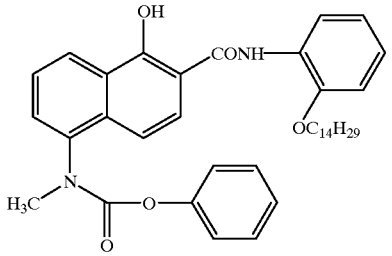

(3)

Synthesis of coupler of compound example (3)

Synthesis of compound 3b

A solution of 41.3 g of dicyclohexylcarbodiimide dissolved in 60 milliliters (hereinafter referred to as "ml") of N,N-dimethylacetamide was dropped at 30° C. into a solution of 50g of compound 3a and 51.1 g of o-tetradecyloxyaniline dissolved in 250 ml of N,N-dimethylacetamide. The reaction mixture was agitated at 50° C. for 1 hr, and 250 ml of ethyl acetate was added thereto. The reaction mixture was cooled to 20° C. and suction-filtered. 250 ml of 1N aqueous hydrochloric acid was added to the obtained filtrate and fractionated. 100 ml of hexane was added to the obtained organic phase. The thus precipitated crystal was harvested by filtration, washed with acetonitrile and dried. As a result, 71 g of compound 3b was obtained.

Synthesis of compound 3c 150 ml of an aqueous solution of 30 g of sodium hydroxide was dropped into a solution of 71 g of compound 3b dissolved in 350 ml of methanol and 70 ml of tetrahydrofuran and agitated in a nitrogen atmosphere at 60° C. for 1 hr. The reaction mixture was cooled to 20° C., and concentrated hydrochloric acid was dropped thereinto until the system was acidified. Precipitated crystal was harvested by filtration, washed with water and then acetonitrile and dried. Thus, 63 g of compound 3c was obtained.

Synthesis of compound 3d 150 ml of a solution obtained by dissolving 20 g of compound 3c, 5.25 g of succinimide and 4.3 ml of a 37% aqueous formaldehyde solution in ethanol was agitated and refluxed for 5 hr, and cooled to 20° C. Precipitated crystal was harvested by filtration and dried. Thus, 16 g of compound 3d was obtained.

Synthesis of compound 3e 1.32 g of sodium borohydride was added at 60° C. to a solution of 7 g of compound 3d dissolved in 70 ml of dimethyl sulfoxide so slowly that the temperature did not exceed 70° C. While maintaining the temperature, the mixture was agitated for 15 min. The thus obtained reaction mixture was slowly added to 100 ml of 1N aqueous hydrochloric acid and extracted with 100 ml of ethyl acetate. The organic phase was washed with water, dried over magnesium sulfate and concentrated at a reduced pressure. Original components were removed by short path column (development solvent: ethyl acetate/hexane=2/1), and recrystallization from ethyl acetate/hexane was performed to thereby obtain 3.3 g of compound 3e.

Synthesis of compound (3)

0.65 g of phenyl chiorocarbonate was dropped at 10° C. into a solution of 2 g of compound 3e and 0.6 g of N,N-dimethylaniline dissolved in 50 ml of ethyl acetate and agitated at 20° C. for 2 hr. 50 ml of 1N aqueous hydrochloric acid was poured into the thus obtained reaction mixture. The organic phase was washed with water, dried over magnesium sulfate and concentrated at a reduced pressure. The concentration residue was purified through column (development solvent: ethyl acetate/hexane=1/5) to thereby obtain 1.9 g of compound example (3) (the identification of the obtained compound was performed by elementary analysis, NMR and mass spectrum).

<Synthesis of coupler of compound example (6)>

Coupler of compound example (6) was synthesized according to the following scheme:

Synthesis of coupler of compound example (6)

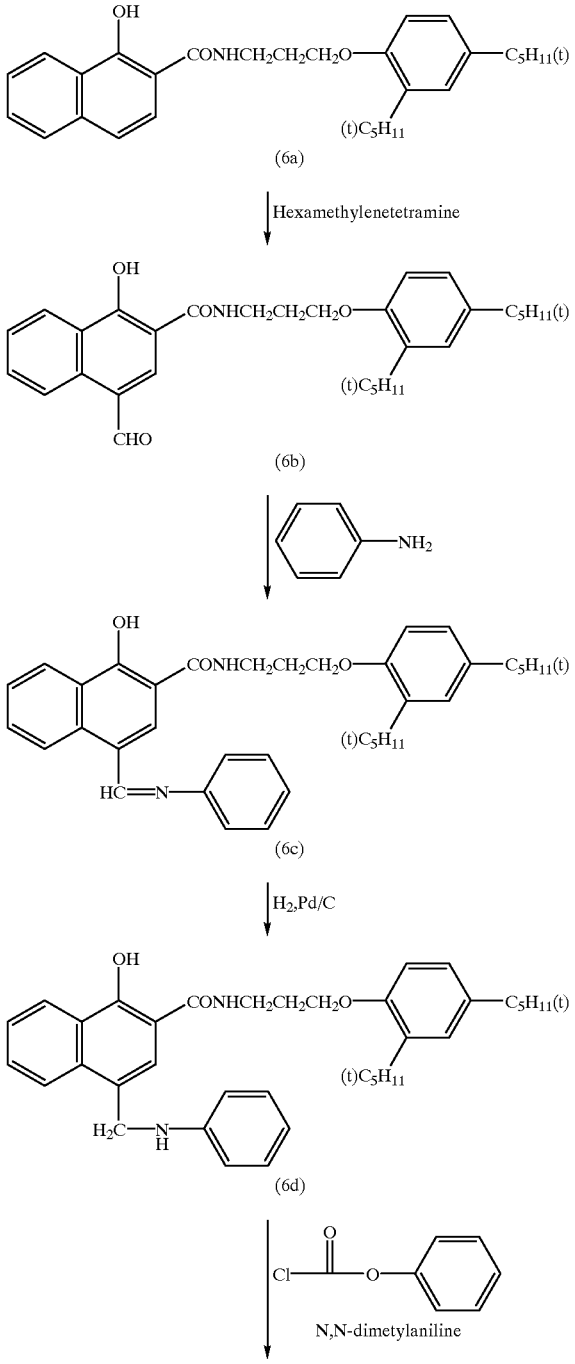

-continued

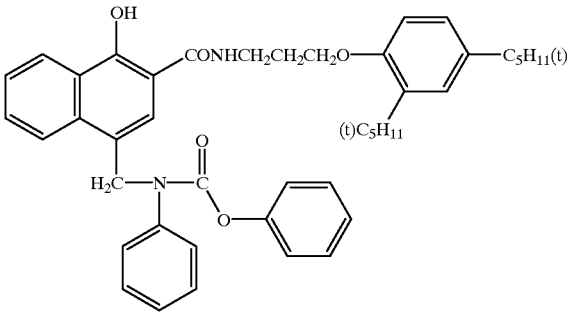

(6)

Synthesis of compound 6b 23.1 g of compound 6a, 7.1 g of hexamethylenetetramine and 6.3 g of $Na_2SO_3$ were agitated in 150 ml of glacial acetic acid at 90° C. for 4 hr. The reaction mixture was cooled to 20° C. Precipitated crystal was harvested by filtration, washed with a small amount of methanol and dried. As a result, 19.8 g of compound 6b was obtained.

Synthesis of compound 6d

A solution of 15.0 g of compound 6b and 3.0 g of aniline dissolved in 200 ml of toluene was agitated and refluxed for 5 hr while removing water. The reaction mixture was cooled to 20° C, and 100 ml of ethyl acetate was added thereto. The mixture was dried over magnesium sulfate and concentrated at a reduced pressure to thereby obtain crude compound 6c. 5 g of 10% Pd/C and 200 ml of ethyl acetate were added to the crude compound 6c and agitated at room temperature in a 20 kg/cm$^2$ hydrogen atmosphere for 3 hr. The catalyst was separated by filtration, and the mixture was concentrated at a reduced pressure. The concentration residue was recrystallized from a mixture of ethyl acetate and hexane, thereby obtaining 13.0 g of compound 6d.

Synthesis of compound (6)

0.61 g of phenyl chlorocarbonate was dropped at 10° C. into a solution of 2.5 g of compound 6d and 0.55 g of N,N-dimethylaniline dissolved in 100 ml of ethyl acetate and agitated at 20° C for 2 hr. 100 ml of 1N aqueous hydrochloric acid was poured into the thus obtained reaction mixture. The organic phase was washed with water, dried over magnesium sulfate and concentrated at a reduced pressure. The concentration residue was purified through column (development solvent: ethyl acetate/hexane=1/3) to thereby obtain 2.2 g of compound example (6) (the identification of the obtained compound was performed by elementary analysis, NMR and mass spectrum).

<Synthesis of coupler of compound example (16)>

Coupler of compound example (16) was synthesized according to the following scheme:

Synthesis of coupler of compound example (16)

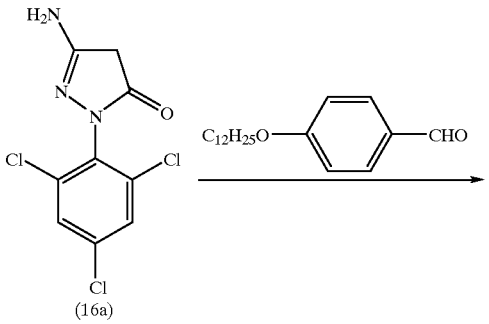

(16a)

-continued

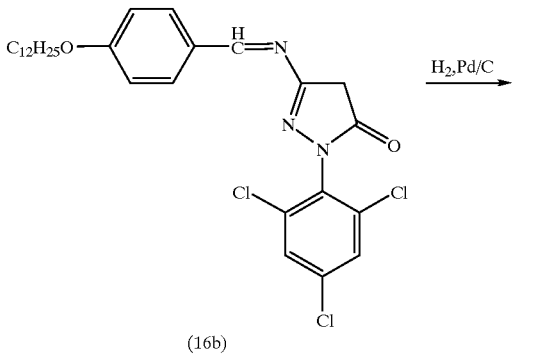

(16b)

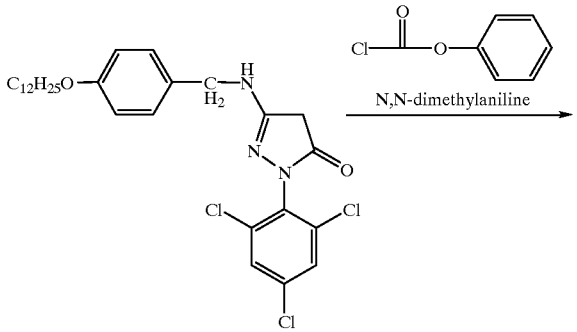

(16c)

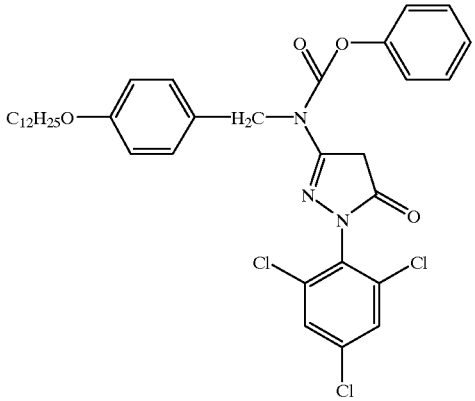

(16)

Synthesis of compound 16b 27.8 g of compound 16a and 29 g of p-dodecyloxybenzaldehyde were agitated under a stream of nitrogen at 120° C. for, 1 hr and cooled to room temperature. The reaction residue was purified through column (development solvent: ethyl acetate/hexane=1/3), thereby obtaining 17.3 g of compound 16b.

Synthesis of compound 16c 4 g of 10% Pd/C and 250 ml of ethyl acetate were added to 17.3 g of compound 16b and agitated at room temperature in a 20 kg/cm$^2$ hydrogen atmosphere for 3 hr. The catalyst was separated by filtration, and the mixture was concentrated at a reduced pressure. The concentration residue was recrystallized from a mixture of ethyl acetate and hexane, thereby obtaining 12.5 g of compound 16c.

Synthesis of compound (16)

1.1 g of phenyl chlorocarbonate was dropped at 10° C. into a solution of 4.4 g of compound 16c and 1.1 g of N,N-dimethylaniline dissolved in 100 ml of ethyl acetate and agitated at 20° C for 2 hr. 100 ml of 1N aqueous hydrochloric acid was poured into the thus obtained reaction mixture. The organic phase was washed with water, dried over magnesium sulfate and concentrated at a reduced pressure. The concentration residue was purified through column (development solvent: ethyl acetate/hexane=1/5) to thereby obtain 2.7 g of compound example (16) (the identification of the obtained compound was performed by elementary analysis, NMR and mass spectrum).

<Synthesis of coupler of compound example (40)>

Coupler of compound example (40) was synthesized according to the following scheme:

Synthesis of coupler of compound example (40)

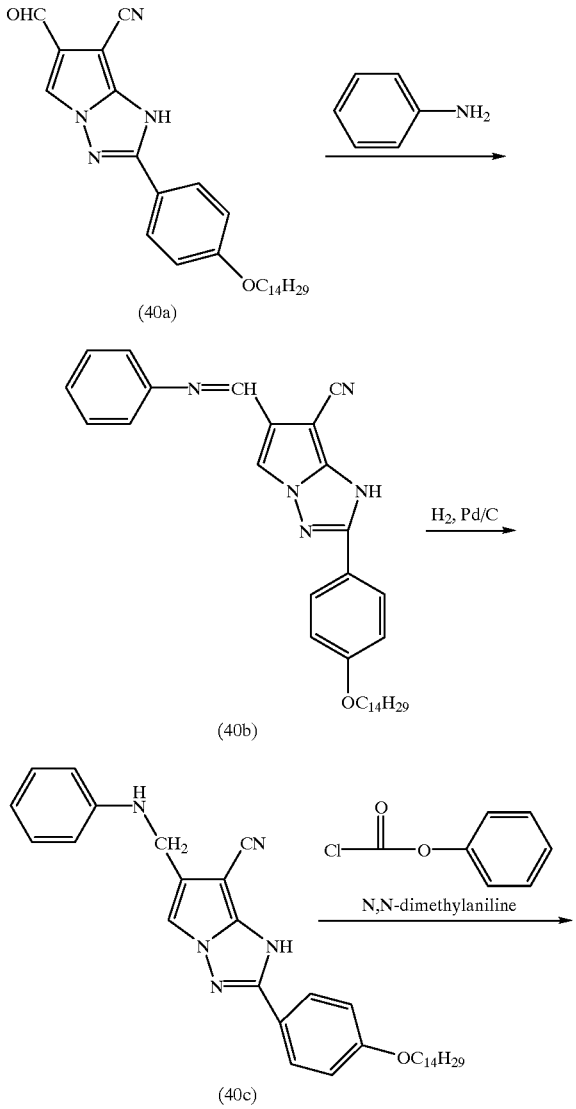

-continued

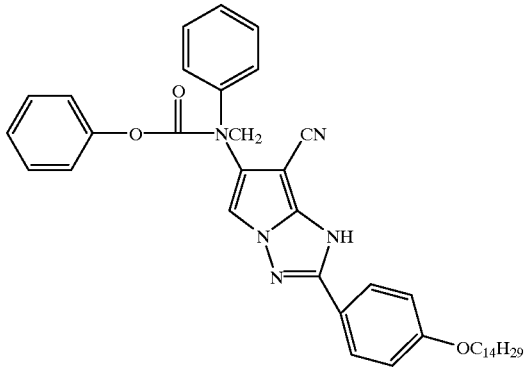

(40)

Synthesis of compound 40c

A solution of 15.9 g of compound 40a and 3.0 g of aniline dissolved in 200 ml of toluene was agitated and refluxed for 5 hr while removing water. The reaction mixture was cooled to 20° C and concentrated at a reduced pressure to thereby obtain crude compound 40b. 5 g of 10% Pd/C and 200 ml of ethyl acetate were added to the crude compound 40b and agitated at room temperature in a 20 kg/cm$^2$ hydrogen atmosphere for 5 hr. The catalyst was separated by filtration, and the mixture was concentrated at a reduced pressure. The concentration residue was recrystallized from a mixture of ethyl acetate and hexane, thereby obtaining 11.5 g of compound 40c.

Synthesis of compound (40)

1.6 g of phenyl chlorocarbonate was dropped into a solution of 5.0 g of compound 40c and 2.0 g of N,N-dimethylaniline dissolved in 100 ml of ethyl acetate and agitated at 20° C. for 2 hr. 100 ml of 1N aqueous hydrochloric acid was poured into the thus obtained reaction mixture. The organic phase was washed with water, dried over magnesium sulfate and concentrated at a reduced pressure. The concentration residue was purified through column (development solvent: ethyl acetate/hexane=1/4) to thereby obtain 3.0 g of compound example (40) (the identification of the obtained compound was performed by elementary analysis, NMR and mass spectrum).

<Synthesis of coupler of compound example (41)>

Coupler of compound example (41) was synthesized according to the following scheme:

Synthesis of coupler of compound example (41)

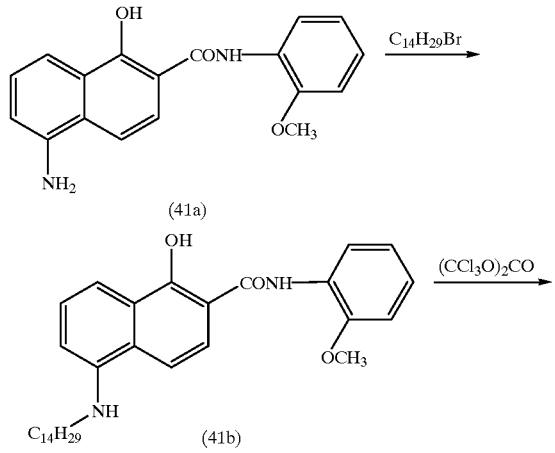

-continued

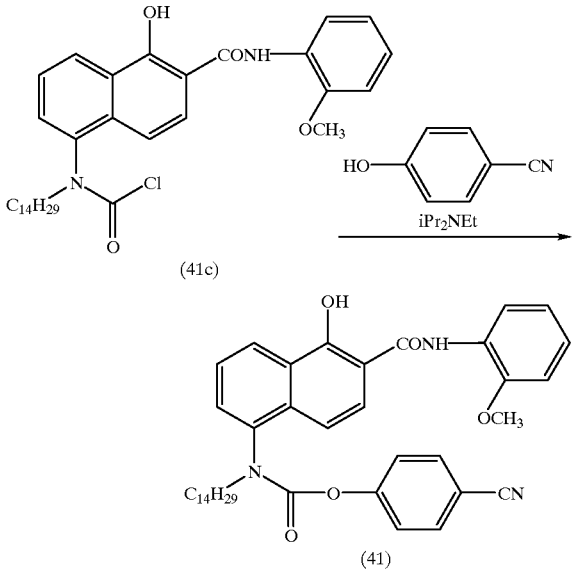

Synthesis of compound 41b

A solution of 50 g of compound 41a, which was synthesized in the same manner as that of the compound 3c, and 78.6 g of bromotetradecane dissolved in 150 ml of 1-methylpyrrolidone was agitated at 120° C. for 5 hr, cooled to 25° C. and poured into a mixture of 600 ml of ethyl acetate and 600 ml of water. The organic phase was washed with water and concentrated at a reduced pressure. The concentration residue was recrystallized from a mixture of ethyl acetate and hexane, thereby obtaining 48 g of compound 41b.

Synthesis of compound 41c

A solution of 6.5 g of compound 41b and 3.1 g of dimethylaniline dissolved in 20 ml of tetrahydrofuran was dropped at 10° C. into a solution of 1.9 g of triphosgene dissolved in 5 ml of tetrahydrofuran. The reaction mixture was agitated at 25° C. for 1 hr and poured into a mixture of 100 ml of ethyl acetate and 100 ml of 1N aqueous hydrochloric acid. The organic phase was washed with water, dried over magnesium sulfate and concentrated at a reduced pressure. The concentration residue was recrystallized from a mixture of ethyl acetate and hexane, thereby obtaining 5.4 g of compound 41c.

Synthesis of compound 41

A solution of 3.0 g of compound 41c, 1.2 g of p-cyanophenol and 1.2 g of N,N-diisopropyl-N-ethylamine dissolved in 100 ml of toluene was agitated at reflux temperature. The reaction mixture was cooled to 30° C., and 100 ml of a 5% aqueous solution of sodium carbonate was poured thereinto. The organic phase was washed with dilute hydrochloric acid and water, dried over magnesium sulfate and concentrated at a reduced pressure. The concentration residue was purified through column (development solvent: ethyl acetate/hexane=1/2), thereby obtaining 2.3 g of compound example (41) (the identification of the obtained compound was performed by elementary analysis, NMR and mass spectrum).

<Synthesis of coupler of compound example (43)>

Coupler of compound example (43) was synthesized according to the following scheme:

Synthesis of coupler of compound example (43)

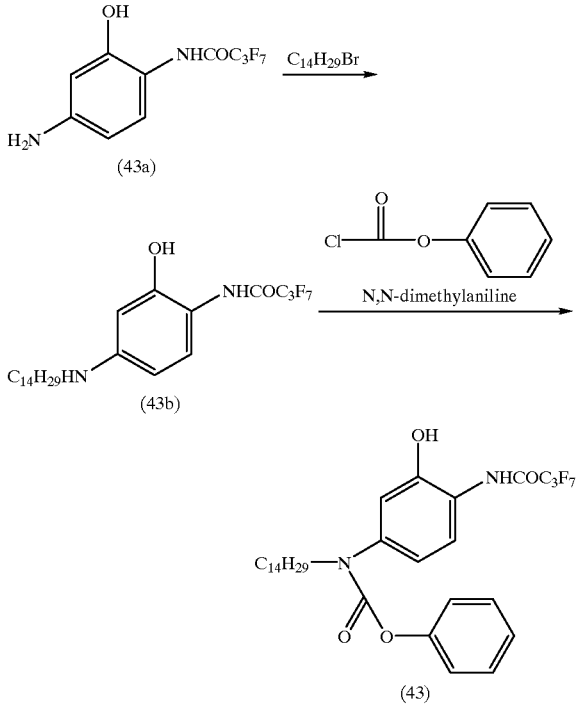

Synthesis of compound 43b

A solution of 20 g of compound 43a and 26 g of bromotetradecane dissolved in 60 ml of 1-methylpyrrolidone was agitated at 120° C. for 5 hr, cooled to 25° C. and poured into a mixture of 400 ml of ethyl acetate and 600 ml of water. The organic phase was concentrated at a reduced pressure. The concentration residue was purified through column (development solvent: ethyl acetate/hexane=1/3), thereby obtaining 9.0 g of compound 43b.

Synthesis of compound 43

2.3 g of phenyl chlorocarbonate was slowly added at 10° C. to a solution of 7.2 g of compound 43b and 4.4 g of N,N-dimethylaniline dissolved in 100 ml of ethyl acetate and agitated at 20° C. for 2 hr. 100 ml of 1N aqueous hydrochloric acid was poured into the thus obtained reaction mixture. The organic phase was washed with water, dried over magnesium sulfate and concentrated at a reduced pressure. The concentration residue was purified through column (development solvent: ethyl acetate/hexane=1/3) to thereby obtain 3.9 g of compound example (43) (the identification of the obtained compound was performed by elementary analysis, NMR and mass spectrum).

<Synthesis of coupler of compound example (44)>

Coupler of compound example (44) was synthesized according to the following scheme:

Synthesis of coupler of compound example (44)

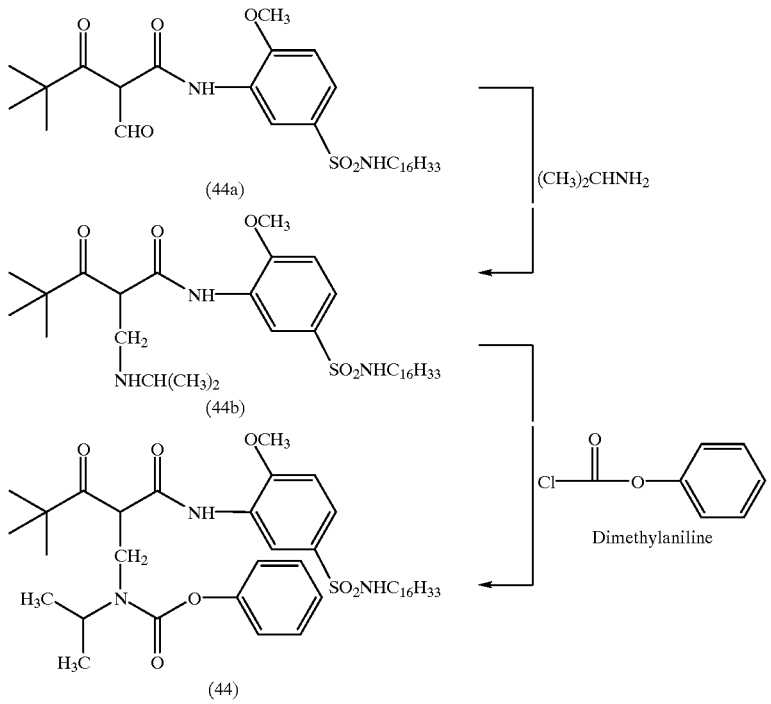

Synthesis of compound 44b

A solution of 20 g of compound 44a and 20 g of propylamine dissolved in 200 ml of toluene was heated and agitated, and concentrated at a reduced pressure. The concentration residue was purified through column (development solvent: ethyl acetate/hexane=1/2), thereby obtaining 7.6 g of compound 44b.

Synthesis of compound 44

1.4 g of phenyl chlorocarbonate was slowly added at 10° C. to a solution of 5.0 g of compound 44b and 1.5 g of N,N-dimethylaniline dissolved in 100 ml of ethyl acetate and agitated at 25° C. for 2 hr. 100 ml of 1N aqueous hydrochloric acid was poured into the thus obtained reaction mixture. The organic phase was washed with water, dried over magnesium sulfate and concentrated at a reduced pressure. The concentration residue was purified through column (development solvent: ethyl acetate/hexane=1/2) to thereby obtain 3.0 g of compound example (44) (the identification of the obtained compound was performed by elementary analysis, NMR and mass spectrum).

<Synthesis of coupler of compound example (47)>

Coupler of compound example (47) was synthesized according to the following scheme:

Synthesis of coupler of compound example (47)

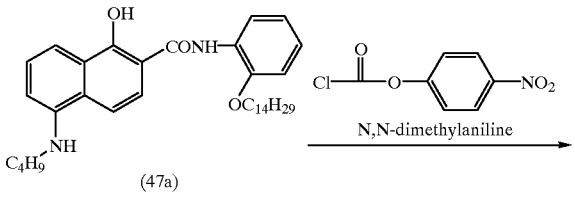

-continued

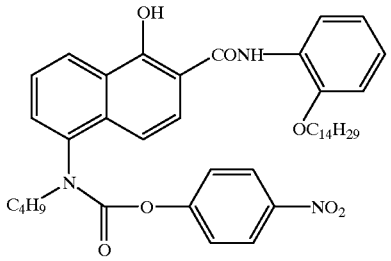

Synthesis of compound (47)

1.6 g of p-nitrophenyl chlorocarbonate was slowly added at 10° C. to a solution of 4.0 g of compound 47a and 1.1 g of N,N-dimethylaniline dissolved in 100 ml of ethyl acetate and agitated at 20° C. for 2 hr. 100 ml of 1N aqueous hydrochloric acid was poured into the thus obtained reaction mixture. The organic phase was washed with water, dried over magnesium sulfate and concentrated at a reduced pressure. The concentration residue was purified through column (development solvent: ethyl acetate/hexane=1/4) to thereby obtain 4.6 g of compound example (47) (the identification of the obtained compound was performed by elementary analysis, NMR and mass spectrum).

The trapping agent for developing agent oxidation products specified in the present invention can be incorporated in any of the layers of the lightsensitive material. Specifically, the trapping agent can be incorporated in any lightsensitive layer (a blue sensitive emulsion layer, a green sensitive emulsion layer, a red sensitive emulsion layer or a donor layer imparting interlayer effect and having a spectral sensitivity distribution different from that of these principal lightsensitive layers) and any nonlightsensitive layer (for example, a protective layer, a yellow filter layer, an interlayer or an antihalation layer). When there are two or more layers which have the same color sensitivity but different speeds, the trapping agent can be added to any of the maximum sensitivity layer, minimum sensitivity layer and intermediate sensitivity layer, or can be added to all of the layers. Preferably, the trapping agent is incorporated in a lightsensitive layer and/or a nonlightsensitive layer adjacent to a lightsensitive layer, more preferably, in a nonlightsensitive layer adjacent to a lightsensitive layer.

The addition amount per layer of the trapping agent for developing agent oxidation products specified in the present invention to the lightsensitive material is in the range of $1\times10^{-6}$ to $1\times10^{-2}$ mol/m$^2$. The addition amount is preferably in the range of $5\times10^{-5}$ to $1\times10^{-3}$ mol/m$^2$, more preferably $1\times10^{-5}$ to $5\times10^{-4}$ mol/m$^2$.

With respect to the application of the trapping agent for developing agent oxidation products specified in the present invention to the lightsensitive material, generally known dispersion methods can be employed in conformity with the type of the compound. For example, when it is soluble in alkali, it can be added in the form of an alkaline aqueous solution or a solution in an organic solvent miscible with water or can be added by the use of the oil-in-water dispersion method, in which use is made of a high-boiling-point organic solvent, or the solid dispersion method.

The trapping agents for developing agent oxidation products specified in the present invention can be used either individually or in combination. Further, the same trapping agent compound can be simultaneously used in two or more layers. Still further, the trapping agents can be used in combination with other generally known compounds capable of releasing a photographically useful group or its precursor, or can be used in combination with below described couplers or other additives. These are appropriately selected in conformity with the performance required to exhibit by the lightsensitive material.

In the lightsensitive material of the present invention, use can be made of not only the above various additives but also other various additives in conformity with the object.

These additives are described in detail in Research Disclosure (RD) Item 17643 (December 1978), Item 18716 (November 1979) and Item 308119 (December 1989), the disclosures of which are herein incorporated by reference. A summary of the locations where they are described is listed below.

| | Types of additives | RD17643 | RD18716 | RD308119 |
|---|---|---|---|---|
| 1 | Chemical sensitizers | page 23 | page 648 right column | page 996 |
| 2 | Sensitivity increasing agents | | page 648 right column | |
| 3 | Spectral sensitizers, super-sensitizers | pages 23–24 | page 648, right column to page 649, right column | page 996, right column to page 998, right column |
| 4 | Brighteners | page 24 | | page 998 right column |
| 5 | Antifoggants, stabilizers | pages 24–25 | page 649 right column | page 998, right column to page 1000, right column |
| 6 | Light absorbents, filter dyes, ultraviolet absorbents | pages 25–26 | page 649, right column to page 650, left column | page 1003, left column to page 1003, right column |
| 7 | Stain preventing agents | page 25, right column | page 650, left to right columns | page 1002, right column |
| | Dye image | page 25 | | page 1002, |

-continued

| | Types of additives | RD17643 | RD18716 | RD308119 |
|---|---|---|---|---|
| | stabilizer | | | right column |
| 9 | Film hardeners | page 26 | page 651, left column | page 1004, right column page 1005, left column |
| 10 | Binders | page 26 | page 651, left column | page 1003, right column to page 1004, right column |
| 11 | Plasticizers, lubricants | page 27 | page 650, right column | page 1006, left to right columns |
| 12 | coating aids, surfactants | pages 26–27 | page 650, right column | page 1005, left column to page 1006, left column |
| 13 | Antistatic agents | page 27 | page 650, right column | page 1006, right column to page 1007, left column |
| 14 | Matting agents | | | page 1008, left column to page 1009, left column. |

Layer arrangement and related techniques, silver halide emulsions, dye forming couplers, DIR couplers and other functional couplers, various additives and development processing which can be used in the lightsensitive material of the present invention are described in EP 0565096A1 (published on Oct. 13, 1993) and patents cited therein, the disclosures of which are herein incorporated by reference. Individual particulars and the locations where they are described will be listed below.

1. Layer construction: page 61 lines 23 to 35, page 61, line 41 to page 62 line 14, 2. Interlayers: page 61 lines 36 to 40, 3. Interlayer effect imparting layers: page 62 lines 15 to 18, 4. Silver halide halogen compositions: page 62 lines 21 to 25, 5. Silver halide grain crystal habits: page 62 lines 26 to 30, 6. Silver halide grain sizes: page 62 lines 31 to 34, 7. Emulsion production methods: page 62 lines 35 to 40, 8. Silver halide grain size distributions: page 62 lines 41 to 42, 9. Tabular grains: page 62 lines 43 to 46, 10. Internal structures of grains: page 62 lines 47 to 53, 11. Latent image forming types of emulsions: page 62 line 54 to page 63 to line 5, 12. Physical ripening and chemical ripening of emulsion: page 63 lines 6 to 9, 13. Emulsion mixing: page 63 lines 10 to 13, 14. Fogging emulsions: page 63 lines 14 to 31, 15. Nonlightsensitive emulsions: page 63 lines 32 to 43, 16. Amounts of coated silver: page 63 lines 49 to 50, 17. Photographic additives: The additives are described in Research Disclosure (RD) Item 17643 (December 1978), Item 18716 (November 1979) and Item 307105 (November 1989). Individual particulars and the locations where they are described will be listed below.

| | Types of additives | RD17643 | RD18716 | RD307105 |
|---|---|---|---|---|
| 1 | Chemical sensitizers | page 23 | page 648 right column | page 866 |
| 2 | Sensitivity increasing agents | | page 648 right column | |
| 3 | Spectral sensitizers, super-sensitizers | pages 23–24 | page 648, right column to page 649, right column | pages 866–868 |
| 4 | Brighteners | page 24 | page 647, right column | page 868 |
| 5 | Antifoggants, stabilizers | pages 24–25 | page 649 right column | pages 868–870 |
| 6 | Light absorbents, filter dyes, ultraviolet absorbents | pages 25–26 | page 649, right column to page 650, left column | page 873 |
| 7 | Stain preventing agents | page 25, right column | page 650, left to right columns | page 872 |
| 8 | Dye image stabilizers | page 25 | page 650, left column | page 872 |
| 9 | Film hardeners | page 26 | page 651, left column | pages 874–875 |
| 10 | Binders | page 26 | page 651, left column | pages 873–874 |
| 11 | Plasticizers, lubricants | page 27 | page 650, right column | page 876 |
| 12 | Coating aids, surfactants | pages 26–27 | page 650, right column | pages 875–876 |
| 13 | Antistatic agents | page 27 | page 650, right column | pages 876–877 |
| 14 | Matting agents | | | pages 878–879. |

18. Formaldehyde scavengers: page 64 lines 54 to 57,
19. Mercapto antifoggants: page 65 lines 1 to 2,
20. Fogging agent, etc. releasing agents: page 65 lines 3 to 7,
21. Dyes: page 65, lines 7 to 10,
22. Color coupler summary: page 65 lines 11 to 13,
23. Yellow, magenta and cyan couplers: page 65 lines 14 to 25,
24. Polymer couplers: page 65 lines 26 to 28,
25. Diffusive dye forming couplers: page 65 lines 29 to 31,
26. Colored couplers: page 65 lines 32 to 38,
27. Functional coupler summary: page 65 lines 39 to 44,
28. Bleaching accelerator releasing couplers: page 65 lines 45 to 48,
29. Development accelerator releasing couplers: page 65 lines 49 to 53,
30. Other DIR couplers: page 65 line 54 to page 66 to line 4,
31. Method of dispersing couplers: page 66 lines 5 to 28,
32. Antiseptic and mildewproofing agents: page 66 lines 29 to 33,
33. Types of sensitive materials: page 66 lines 34 to 36,
34. Thickness of lightsensitive layer and swelling velocity: page 66 line 40 to page 67 line 1,
35. Back layers: page 67 lines 3 to 8,
36. Development processing summary: page 67 lines 9 to 11,
37. Developers and developing agents: page 67 lines 12 to 30,
38. Developer additives: page 67 lines 31 to 44,
39. Reversal processing: page 67 lines 45 to 56,
40. Processing solution aperture ratio: page 67 line 57 to page 68 line 12,
41. Development time: page 68 lines 13 to 15,
42. Bleach-fix, bleaching and fixing: page 68 line 16 to page 69 line 31,
43. Automatic processor: page 69 lines 32 to 40,
44. Washing with water, rinse and stabilization: page 69 line 41 to page 70 line 18,
45. Processing solution replenishment and recycling: page 70 lines 19 to 23,
46. Sensitive material containing developing agent: page 70 lines 24 to 33,
47. Development processing temperature: page 70 lines 34 to 38, and
48. Application to film with lens: page 70 lines 39 to 41.

EXAMPLE

The present invention will be described in more detail below by way of its examples. However, the present invention is not limited to these examples as long as the invention does not depart from the gist of the invention.

Example 1

A support of cellulose triacetate film furnished with a substratum was coated with a plurality of layers of the following compositions, thereby preparing multilayer color lightsensitive material sample 101.

Use was made of the same couplers, emulsions and other components as described in Example 2. The figure given beside the description of each component is for the coating amount expressed in the unit of g/m$^2$, and, with respect to a silver halide emulsion, the coating amount is in terms of silver, provided that, regarding a sensitizing dye, the coating amount is expressed in the unit of mol per mol of silver halide present in the same layer.

(Sample 101)

1st layer (Low-speed red-sensitive silver halide emulsion layer)

same as the fourth layer of Example 2.

2nd layer (Medium-speed red-sensitive silver halide emulsion layer)

same as the fifth layer of Example 2.

3rd layer (High-speed red-sensitive silver halide emulsion layer)

same as the sixth layer of Example 3.

| | |
|---|---|
| 4th layer (Interlayer) | |
| Cpd-3 | 0.025 |
| HBS-1 | 0.025 |
| Polyethyl acrylate latex | 0.83 |
| Gelatin | 0.84 |
| 5th layer (Magenta coupler containing layer) | |
| ExM-2 | 0.36 |
| ExM-3 | 0.045 |
| HBS-1 | 0.28 |
| HBS-3 | 0.01 |
| HBS-4 | 0.27 |
| Gelatin | 1.39 |
| 6th layer (Protective layer) | |
| H-1 | 0.33 |
| B-1 (diameter 1.7 $\mu$m) | 0.05 |
| B-2 (diameter 1.7 $\mu$m) | 0.15 |
| S-1 | 0.20 |
| Gelatin | 2.0 |

Samples 102 to 111 were prepared in the same manner as sample 101 except that the color mixing inhibitor Cpd-3 of the fourth layer was changed as indicated below. In the changing of the Cpd-3 to another color mixing inhibitor, the coating amount per m$^2$ thereof was the same as that of Cpd-3

(equimolar coating). High-boiling organic solvent HBS-1 was applied in the same weight as that of the color mixing inhibitor.

TABLE 1

| Sample No. | Color mixing inhibitor | Remarks |
|---|---|---|
| 102 | None | Comp. |
| 103 | QS-1 | Comp. (compd. ex. 12 of JP-A-59-171955) |
| 104 | QS-2 | Comp. (compd. ex. (1) of JP-A-1-129252) |
| 105 | Compd. ex. (2) | Invention |
| 106 | Compd. ex. (5) | Invention |
| 107 | Compd. ex. (8) | Invention |
| 108 | Compd. ex. (12) | Invention |
| 109 | Compd. ex. (17) | Invention |
| 110 | Compd. ex. (32) | Invention |
| 111 | Compd. ex. (47) | Invention |

The structures of the comparative compounds are as follows:

QS-1

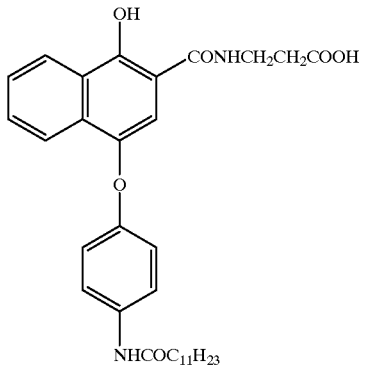

Exemplified compound 12 disclosed in JP-A-59-171955

QS-2

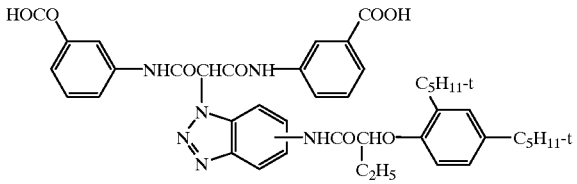

Exemplified compound (1) disclosed in JP-A-1-129252

With respect to the above samples 101 to 111, the compounds of the present invention and the comparative compounds were evaluated. Specifically, the samples were subjected to white light wedge exposure for imparting gradation and thereafter to the same development processing for color negative film as in Example 2.

Subsequently, the cyan color density and magenta color density of each of the samples were measured with the use of red filters and green filters, respectively.

When developing agent oxidation products generated in the color development of a red-sensitive silver halide emulsion layer are diffused into a green-sensitive silver halide emulsion layer, the developing agent oxidation products react with a magenta coupler to thereby effect magenta coloring. Therefore, the capability of inhibiting color mixing of the interlayer (color mixing inhibiting layer), namely the capability of inhibiting color mixing of the color mixing inhibitor, can be evaluated. In the samples of this Example, the fifth layer (magenta coupler containing layer) was freed of any lightsensitive silver halide emulsion. Consequently, the degree of color mixing truly attributable to the diffusion of developing agent oxidation products from a red-sensitive silver halide emulsion layer into a green-sensitive silver halide emulsion layer could be evaluated.

The capability of inhibiting color mixing was evaluated on the basis of magenta color density at an exposure realizing an intermediate density of gradation zone of cyan color density characteristic curve. The lower the magenta color density, the greater the capability of inhibiting color mixing. The results are given in Table 2.

TABLE 2

| Sample No. | Color-mixing preventing agent | Color density of magenta | Remarks |
|---|---|---|---|
| 101 | Cpd-3 | 0.64 | Comparison |
| 102 | none | 0.70 | Comparison |
| 103 | QS-1 | 0.66 | Comparison (Exemplified compound 12 of JP-A-59-171955) |
| 104 | QS-2 | 0.63 | Comparison (Exemplified compound (1) of JP-A-1-129252) |
| 105 | Exemplified compound (2) | 0.61 | Invention |
| 106 | Exemplified compound (5) | 0.60 | Invention |
| 107 | Exemplified compound (8) | 0.59 | Invention |
| 108 | Exemplified compound (12) | 0.61 | Invention |
| 109 | Exemplified compound (17) | 0.58 | Invention |
| 110 | Exemplified compound (32) | 0.57 | Invention |
| 111 | Exemplified compound (47) | 0.59 | Invention |

It is apparent from Table 2 that the compounds of the present invention exhibit high color mixing inhibiting capability. Another advantage thereof over the comparative compounds (103 and 104) is that, while the comparative compounds are outflowing dye forming couplers to thereby cause dyes formed after trapping of developing agent oxidation products to mix into the processing solution with the result that the processing solution is contaminated, the couplers of the present invention form colorless cyclic products concurrently with the trapping of developing agent oxidation products and remain in the lightsensitive material to thereby be free from the danger of contaminating the processing solution.

Example 2

A support of cellulose triacetate film furnished with a substratum was coated with a plurality of layers of the following compositions, thereby preparing multilayer color lightsensitive material sample 201.

(Composition of lightsensitive layer)

Main materials used in each layer are classified as follows:

ExC: cyan coupler, UV: ultraviolet absorber,

ExM: magenta coupler, HBS: high b.p. org. solvent,

ExY: yellow coupler, H: gelatin hardener,

ExS: sensitizing dye.

The numeric value given beside the description of each component is for the coating amount expressed in the unit of $g/m^2$. With respect to the silver halide, the coating amount is in terms of silver. Regarding the sensitizing dye, however, the coating amount is expressed in the unit of mol per mol of silver halide present in the same layer.

(Sample 201)

| | | |
|---|---|---|
| 1st layer (First antihalation layer) | | |
| Black colloidal silver | silver | 0.155 |
| Silver iodobromide emulsion P | silver | 0.01 |
| Gelatin | | 0.87 |
| ExC-1 | | 0.002 |
| ExC-3 | | 0.002 |
| Cpd-2 | | 0.001 |
| HBS-1 | | 0.004 |
| HBS-2 | | 0.002 |
| 2nd layer (Second antihalation layer) | | |
| Black colloidal silver | silver | 0.066 |
| Gelatin | | 0.407 |
| ExM-1 | | 0.050 |
| ExF-1 | | $2.0 \times 10^{-3}$ |
| HBS-1 | | 0.074 |
| Solid dispersed dye ExF-2 | | 0.015 |
| Solid dispersed dye ExF-3 | | 0.020 |
| 3rd layer (Interlayer) | | |
| Silver iodobromide emulsion O | | 0.020 |
| ExC-2 | | 0.022 |
| Polyethyl acrylate latex | | 0.085 |
| Gelatin | | 0.294 |
| 4th layer (Low-speed red-sensitive emulsion layer) | | |
| Silver iodobromide emulsion A | silver | 0.323 |
| ExS-1 | | $5.5 \times 10^{-4}$ |
| ExS-2 | | $1.0 \times 10^{-5}$ |
| ExS-3 | | $2.4 \times 10^{-4}$ |
| ExC-1 | | 0.109 |
| ExC-3 | | 0.044 |
| ExC-4 | | 0.072 |
| ExC-5 | | 0.011 |
| ExC-6 | | 0.003 |
| Cpd-2 | | 0.025 |
| Cpd-4 | | 0.025 |
| HBS-1 | | 0.17 |
| Gelatin | | 0.80 |
| 5th layer (Medium-speed red-sensitive emulsion layer) | | |
| Silver iodobromide emulsion B | silver | 0.28 |
| Silver iodobromide emulsion C | silver | 0.54 |
| ExS-1 | | $5.0 \times 10^{-4}$ |
| ExS-2 | | $1.0 \times 10^{-5}$ |
| ExS-3 | | $2.0 \times 10^{-4}$ |
| ExC-1 | | 0.14 |
| ExC-2 | | 0.026 |
| ExC-3 | | 0.020 |
| ExC-4 | | 0.12 |
| ExC-5 | | 0.016 |
| ExC-6 | | 0.007 |
| Cpd-2 | | 0.036 |
| Cpd-4 | | 0.028 |
| HBS-1 | | 0.16 |
| Gelatin | | 1.18 |
| 6th layer (High-speed red-sensitive emulsion layer) | | |
| Silver iodobromide emulsion D | silver | 1.47 |
| ExS-1 | | $3.7 \times 10^{-4}$ |
| ExS-2 | | $1.0 \times 10^{-5}$ |
| ExS-3 | | $1.8 \times 10^{-4}$ |
| ExC-1 | | 0.18 |

-continued

| | | |
|---|---|---|
| ExC-3 | | 0.07 |
| ExC-6 | | 0.029 |
| ExC-7 | | 0.010 |
| ExY-5 | | 0.008 |
| Cpd-2 | | 0.046 |
| Cpd-4 | | 0.077 |
| HBS-1 | | 0.25 |
| HBS-2 | | 0.12 |
| Gelatin | | 2.12 |
| 7th layer (Interlayer) | | |
| Cpd-1 | | 0.089 |
| Solid disperse dye ExF-4 | | 0.030 |
| HBS-1 | | 0.050 |
| Polyethyl acrylate latex | | 0.83 |
| Gelatin | | 0.84 |
| 8th layer (Layer capable of exerting interlayer effect on red-sensitive layer) | | |
| Silver iodobromide emulsion E | silver | 0.560 |
| ExS-6 | | $1.7 \times 10^{-4}$ |
| ExS-10 | | $4.6 \times 10^{-4}$ |
| Cpd-4 | | 0.030 |
| ExM-2 | | 0.096 |
| ExM-3 | | 0.028 |
| ExY-1 | | 0.031 |
| HBS-1 | | 0.085 |
| HBS-3 | | 0.003 |
| Gelatin | | 0.58 |
| 9th layer (Low-speed green-sensitive emulsion layer) | | |
| Silver iodobromide emulsion F | silver | 0.39 |
| Silver iodobromide emulsion G | silver | 0.28 |
| Silver iodobromide emulsion H | silver | 0.35 |
| ExS-4 | | $2.4 \times 10^{-5}$ |
| ExS-5 | | $1.0 \times 10^{-4}$ |
| ExS-6 | | $3.9 \times 10^{-4}$ |
| ExS-7 | | $7.7 \times 10^{-5}$ |
| ExS-8 | | $3.3 \times 10^{-4}$ |
| ExM-2 | | 0.36 |
| ExM-3 | | 0.045 |
| HBS-1 | | 0.28 |
| HBS-3 | | 0.01 |
| HBS-4 | | 0.27 |
| Gelatin | | 1.39 |
| 10th layer (Medium-speed green-sensitive emulsion layer) | | |
| Silver iodobromide emulsion I | silver | 0.45 |
| ExS-4 | | $5.3 \times 10^{-5}$ |
| ExS-7 | | $1.5 \times 10^{-4}$ |
| ExS-8 | | $6.3 \times 10^{-4}$ |
| ExC-6 | | 0.009 |
| ExM-2 | | 0.031 |
| ExM-3 | | 0.029 |
| ExY-1 | | 0.006 |
| ExM-4 | | 0.028 |
| HBS-1 | | 0.064 |
| HBS-3 | | $2.1 \times 10^{-3}$ |
| Gelatin | | 0.44 |
| 11th layer (High-speed green-sensitive emulsion layer) | | |
| Silver iodobromide emulsion I | silver | 0.19 |
| Silver iodobromide emulsion J | silver | 0.80 |
| ExS-4 | | $4.1 \times 10^{-5}$ |
| ExS-7 | | $1.1 \times 10^{-4}$ |
| ExS-8 | | $4.9 \times 10^{-4}$ |
| ExC-6 | | 0.004 |
| ExM-1 | | 0.016 |
| ExM-3 | | 0.036 |
| ExM-4 | | 0.020 |
| ExM-5 | | 0.004 |
| ExY-5 | | 0.003 |
| ExM-2 | | 0.013 |
| Cpd-3 | | 0.004 |
| Cpd-4 | | 0.007 |
| HBS-1 | | 0.18 |
| Polyethyl acrylate latex | | 0.099 |
| Gelatin | | 1.11 |

-continued

| | | |
|---|---|---|
| 12th layer (Yellow filter layer) | | |
| Yellow colloidal silver | silver | 0.047 |
| Cpd-1 | | 0.16 |
| Solid dispersed dye ExF-5 | | 0.020 |
| Solid dispersed dye ExF-6 | | 0.020 |
| Oil soluble dye ExF-7 | | 0.010 |
| HBS-1 | | 0.082 |
| Gelatin | | 1.057 |
| 13th layer (Low-speed blue-sensitive emulsion layer) | | |
| Silver iodobromide emulsion K | silver | 0.18 |
| Silver iodobromide emulsion L | silver | 0.20 |
| Silver iodobromide emulsion M | silver | 0.07 |
| ExS-9 | | $4.4 \times 10^{-4}$ |
| ExS-10 | | $4.0 \times 10^{-4}$ |
| ExC-1 | | 0.041 |
| ExC-8 | | 0.012 |
| ExY-1 | | 0.035 |
| ExY-2 | | 0.71 |
| ExY-3 | | 0.10 |
| ExY-4 | | 0.005 |
| Cpd-2 | | 0.10 |
| Cpd-3 | | $4.0 \times 10^{-3}$ |
| HBS-1 | | 0.24 |
| Gelatin | | 1.41 |
| 14th layer (High-speed blue-sensitive emulsion layer) | | |
| Silver iodobromide emulsion N | silver | 0.75 |
| ExS-9 | | $3.6 \times 10^{-4}$ |
| ExC-1 | | 0.013 |
| ExY-2 | | 0.31 |
| ExY-3 | | 0.05 |
| EXY-6 | | 0.062 |
| Cpd-2 | | 0.075 |
| Cpd-3 | | $1.0 \times 10^{-3}$ |
| HBS-1 | | 0.10 |
| Gelatin | | 0.91 |
| 15th layer (1st protective layer) | | |
| Silver iodobromide emulsion O | silver | 0.30 |
| UV-1 | | 0.21 |
| UV-2 | | 0.13 |
| UV-3 | | 0.20 |

-continued

| | |
|---|---|
| UV-4 | 0.025 |
| F-18 | 0.009 |
| HBS-1 | 0.12 |
| HBS-4 | $5.0 \times 10^{-2}$ |
| Gelatin | 2.3 |
| 16th layer (2nd protective layer) | |
| H-1 | 0.40 |
| B-1 (diameter 1.7 $\mu$m) | $5.0 \times 10^{-2}$ |
| B-2 (diameter 1.7 $\mu$m) | 0.15 |
| B-3 | 0.05 |
| S-1 | 0.20 |
| Gelatin | 0.75 |

In addition to the above components, W-1 to W-5, B-4 to B-6, F-1 to F-18, an iron salt, a lead salt, a gold salt, a platinum salt, a palladium salt, an iridium salt, a ruthenium salt and a rhodium salt were appropriately added to the individual layers in order to improve the storage life, processability, resistance to pressure, antiseptic and mildew-proofing properties, antistatic properties and coating properties thereof. Moreover, an aqueous solution of calcium nitrate was added to the coating liquids for the 8th layer and the 11th layer so that the coating liquids for the 8th layer and the 11th layer contained $8.5\times10^{-3}$ g and $7.9\times10^{-3}$ g of calcium, respectively, per mol of silver halide before the formation of the sample.

With respect to the emulsions indicated above by abbreviation, the AgI content, grain size, surface iodine content, etc. are specified in the following Table 3. The surface iodine content can be determined by XPS in the following manner. Each sample was cooled to −115° C. in vacuum of 1×10 Torr or less and irradiated with MgK$\alpha$ as probe X-rays at an X-ray source voltage of 8 kV and an X-ray current of 20 mA. Measuring was performed with respect to Ag3d5/2, Br3d, 13d5/2 electrons, and the integrated intensity of measured peaks was corrected with a sensitivity factor. The surface iodine content was determined from obtained intensity ratio.

TABLE 3

| Emulsion name | Average iodide content (mol %) | Variation coefficient concerning inter-grain iodide distribution) | Average grain size (equivalent-sphere diameter; $\mu$m) | Variation coefficient (%) of equivalent-sphere diameter | Projected area diameter (equivalent-circular diameter: $\mu$m) | Diameter/thickness ratio | Surface iodide content (mol %) | Grain shape |
|---|---|---|---|---|---|---|---|---|
| Emulsion | | | | | | | | |
| A | 3.9 | 20 | 0.37 | 19 | 0.40 | 2.7 | 2.3 | Tabular grain |
| B | 5.1 | 17 | 0.52 | 21 | 0.67 | 5.2 | 3.5 | Tabular grain |
| C | 7.0 | 18 | 0.86 | 22 | 1.27 | 5.9 | 5.2 | Tabular grain |
| D | 4.2 | 17 | 1.00 | 18 | 1.53 | 6.5 | 2.8 | Tabular grain |
| E | 7.2 | 22 | 0.87 | 22 | 1.27 | 5.7 | 5.3 | Tabular grain |
| F | 2.6 | 18 | 0.28 | 19 | 0.28 | 1.3 | 1.7 | Tabular grain |
| G | 4.0 | 17 | 0.43 | 19 | 0.58 | 3.3 | 2.3 | Tabular grain |
| H | 5.3 | 18 | 0.52 | 17 | 0.79 | 6.5 | 4.7 | Tabular grain |
| I | 5.5 | 16 | 0.73 | 15 | 1.03 | 5.5 | 3.1 | Tabular grain |
| J | 7.2 | 19 | 0.93 | 18 | 1.45 | 5.5 | 5.4 | Tabular grain |

TABLE 3-continued

| Emulsion name | Average iodide content (mol %) | Variation coefficient concerning inter-grain iodide distribution) | Average grain size (equivalent-sphere diameter; μm) | Variation coefficient (%) of equivalent-sphere diameter | Projected area diameter (equivalent-circular diameter: μm) | Diameter/thickness ratio | Surface iodide content (mol %) | Grain shape |
|---|---|---|---|---|---|---|---|---|
| K | 1.7 | 18 | 0.40 | 16 | 0.52 | 6.0 | 2.1 | Tabular grain |
| L | 8.7 | 22 | 0.64 | 18 | 0.86 | 6.3 | 5.8 | Tabular grain |
| M | 7.0 | 20 | 0.51 | 19 | 0.82 | 5.0 | 4.9 | Tabular grain |
| N | 6.5 | 22 | 1.07 | 24 | 1.52 | 7.3 | 3.2 | Tabular grain |
| O | 1.0 | — | 0.07 | — | 0.07 | 1.0 | — | Uniform structure |
| P | 0.9 | — | 0.07 | — | 0.07 | 1.0 | — | Uniform structure |

With respect to Table 3, (1) the emulsions L to O were subjected to reduction sensitization using thiourea dioxide and thiosulfonic acid at the time of grain preparation in accordance with Examples of JP-A-2-191938;

(2) the emulsions A to O were subjected to gold sensitization, sulfur sensitization and selenium sensitization in the presence of spectral sensitizing dye indicated in the relevant lightsensitive layer and sodium thiocyanate in accordance with Examples of JP-A-3-237450;

(3) low-molecular-weight gelatin was used in the preparation of tabular grains in accordance with Examples of JP-A-1-158426; and (4) dislocation lines as described in JP-A-3-237450 were observed in the tabular grains by means of a high-voltage electron microscope.

Preparation of dispersion of organic solid disperse dye:

The above ExF-2 was dispersed by the following method. Specifically, 21.7 ml of water, 3 ml of a 5% aqueous solution of sodium p-octylphenoxyethoxyethoxyethanesulfonate and 0.5 g of a 5% aqueous solution of p-octylphenoxy polyoxyethylene ether (polymerization degree: 10) were placed in a 700-ml pot mill, and 5.0 g of dye ExF-2 and 500 ml of zirconium oxide beads (diameter 1 mm) were charged in the mill. The contents were dispersed for 2 hr. This dispersion was conducted by using a BO type oscillating ball mill manufactured by Chuo Koki K.K. Thereafter, the contents were removed from the mill and added to 8 g of a 12.5% aqueous solution of gelatin. The beads were removed by filtration, thereby obtaining a gelatin dispersion of the dye. The average diameter of the dye fine grains was 0.44 μm.

Solid dispersions of ExF-3, ExF-4 and ExF-6 were obtained in the same manner. The average diameters of these dye fine grains were 0.24 μm, 0.45 μm and 0.52 μm, respectively. ExF-5 was dispersed by the -microprecipitation dispersion method described in Example 1 of EP. No. 549,489A. The average grain diameter was 0.06 μm.

The compounds used in the preparation of each of the above layers are listed below.

ExC-1

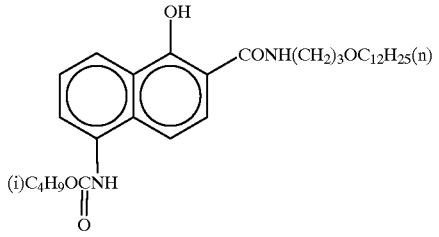

ExC-2

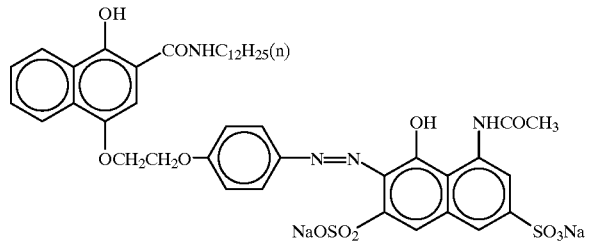

ExC-3

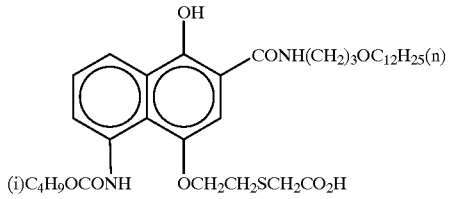

ExC-4

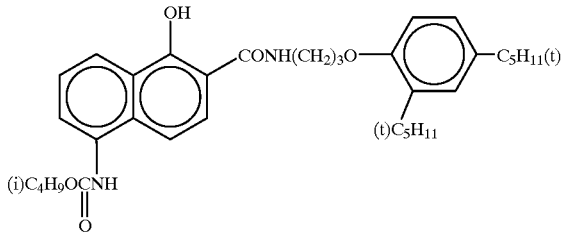

-continued
ExC-5
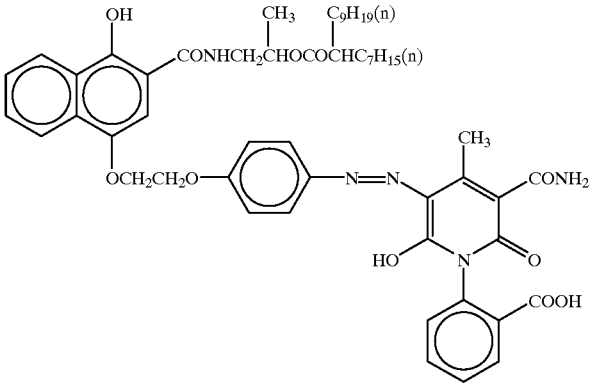
ExC-6
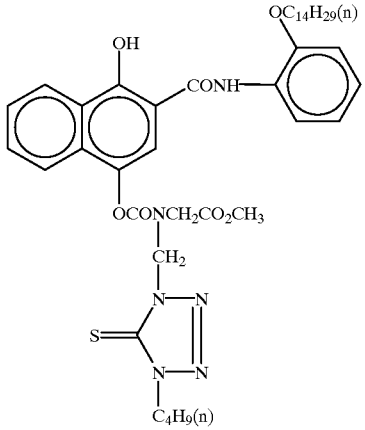
ExC-7
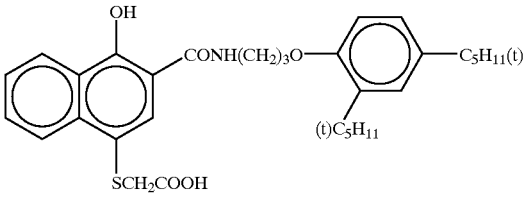
ExC-8
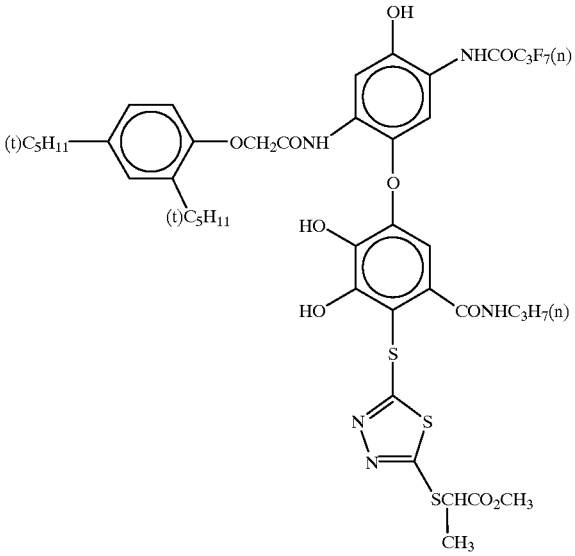
ExM-1
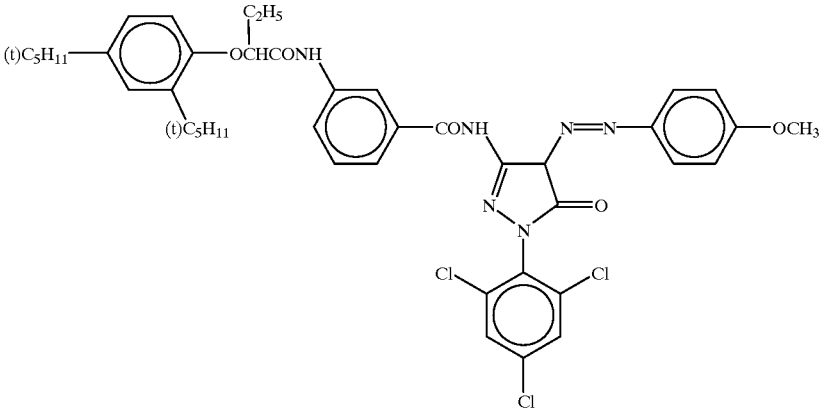

-continued
ExM-2
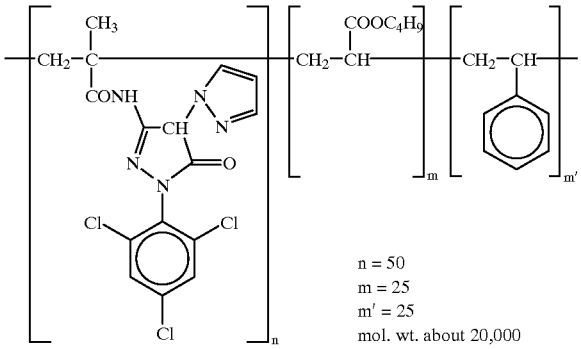
ExM-3
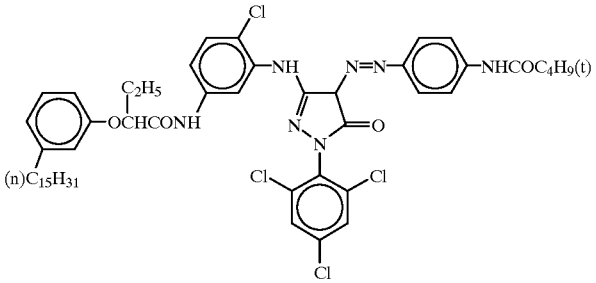
ExM-4
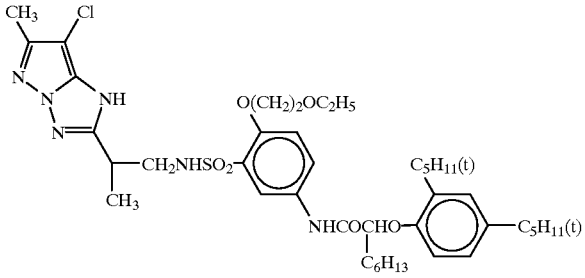
ExM-5
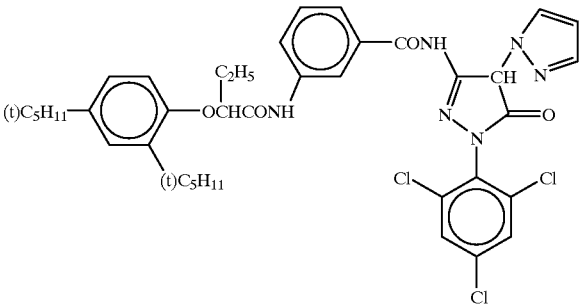
ExY-1
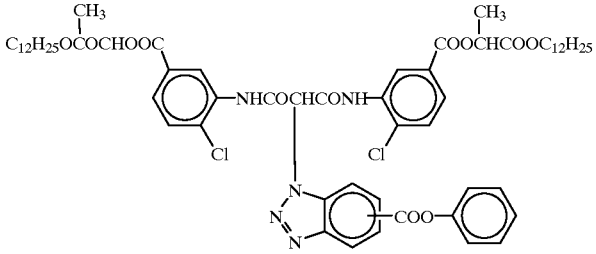
ExY-2
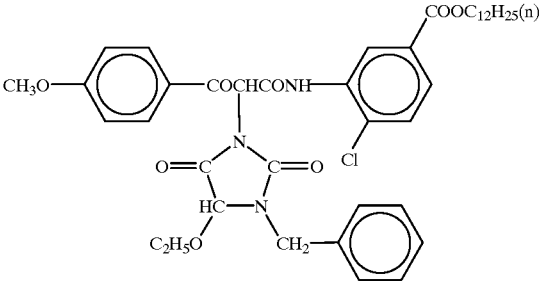
ExY-3
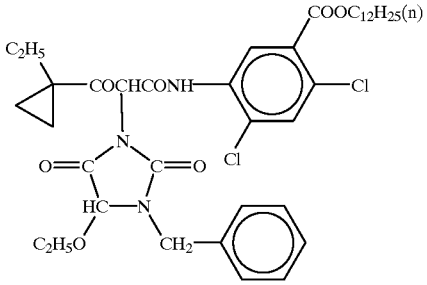
ExY-4
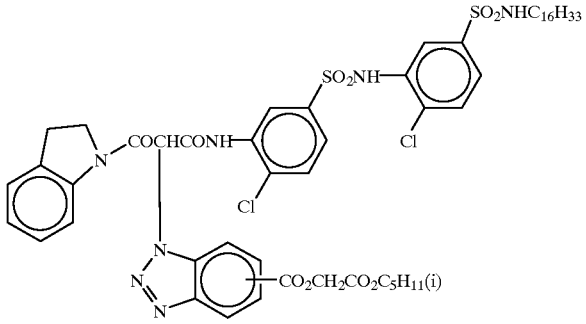

-continued
ExY-5
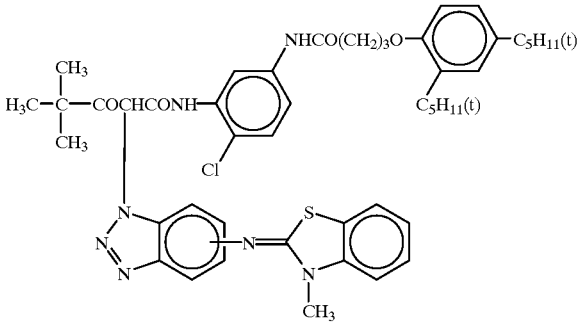
ExY-6
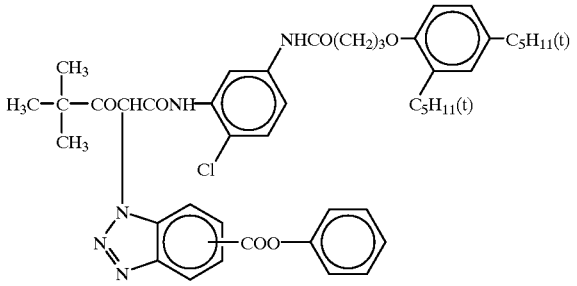
ExF-1
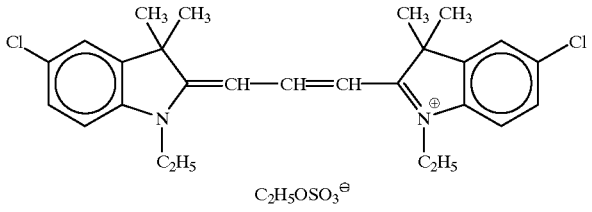
ExF-2
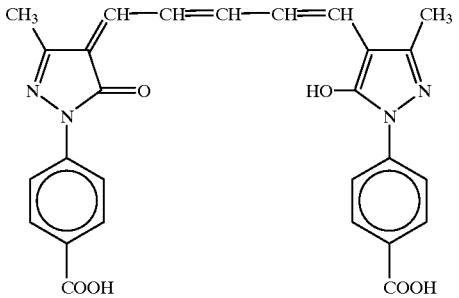
ExF-3
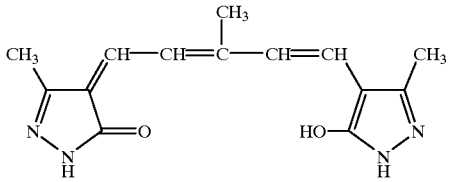
ExF-4
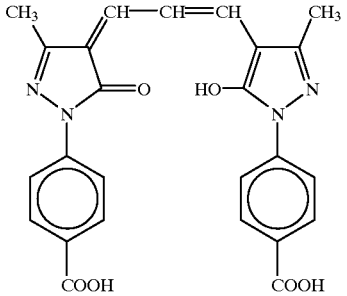
ExF-5
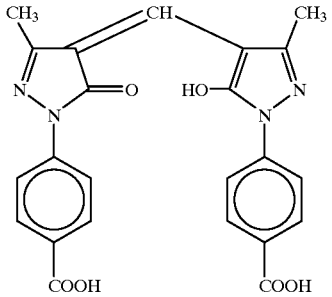
ExF-6
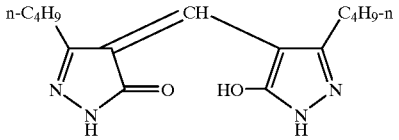
ExF-7
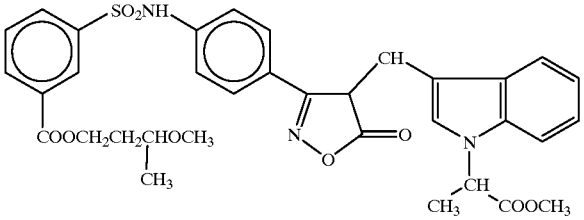
ExF-8
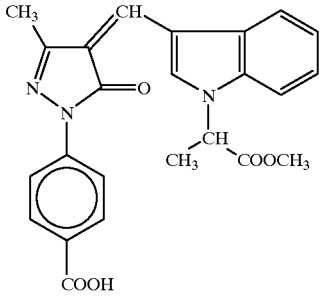

-continued
Cpd-1
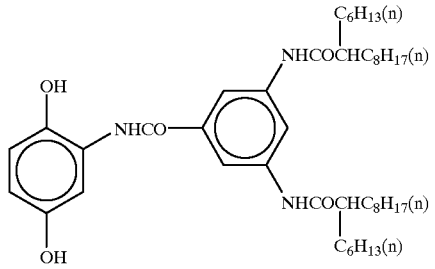
Cpd-2
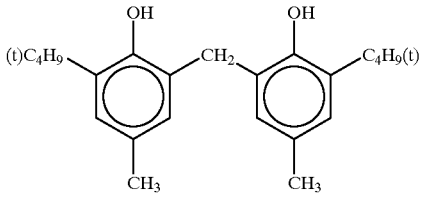
Cpd-3
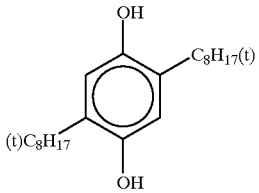
Cpd-4
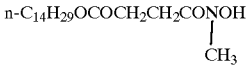
UV-1
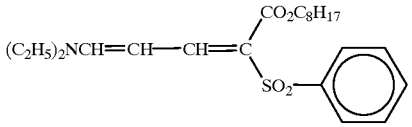
UV-4
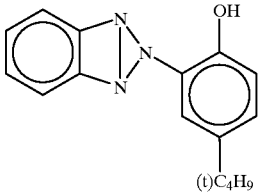
UV-3
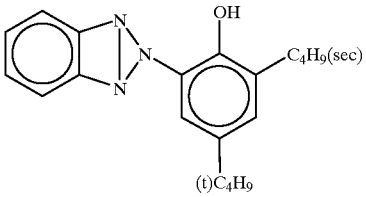
UV-4
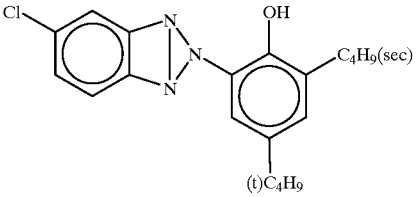
HBS-1 Tricresyl phosphate
HBS-2 Di-n-butylphthalate
HBS-3
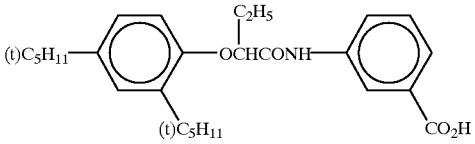
HBS-4 Tri(2-ethylhexyl)phosphate
ExS-1
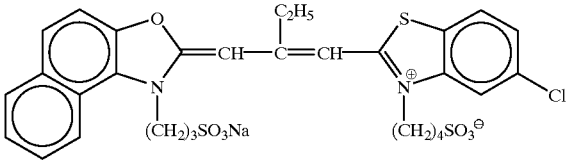
-continued
ExS-2
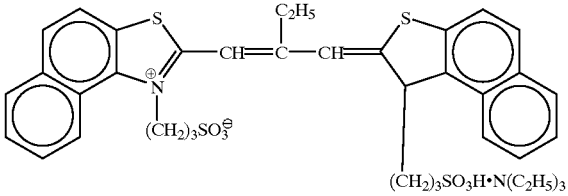
ExS-3
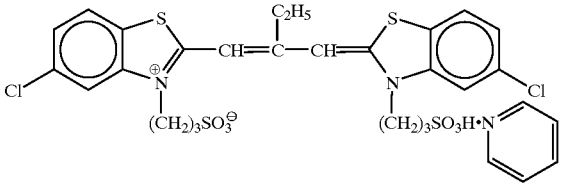

-continued
ExS-4
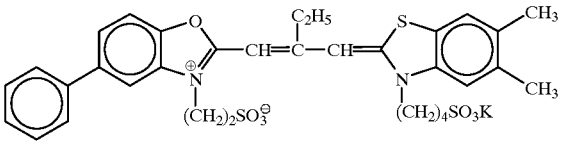
ExS-5
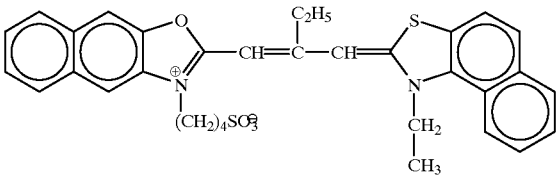
ExS-6
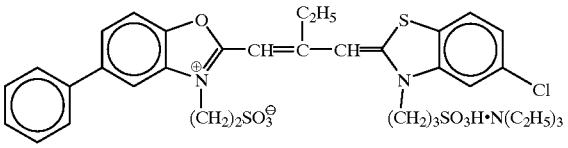
ExS-7
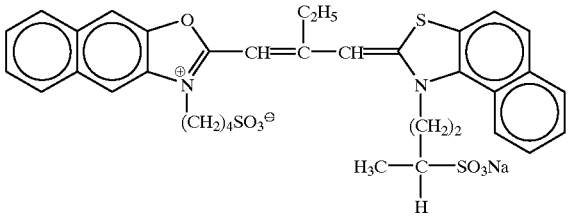
ExS-8
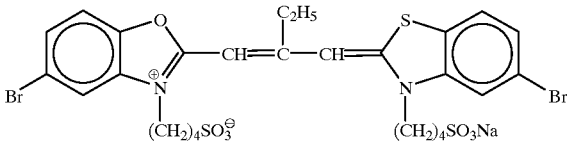
ExS-9
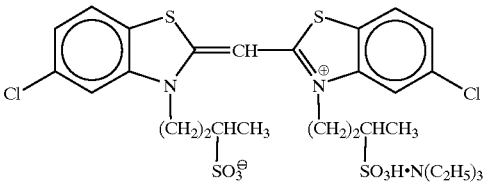
ExS-10
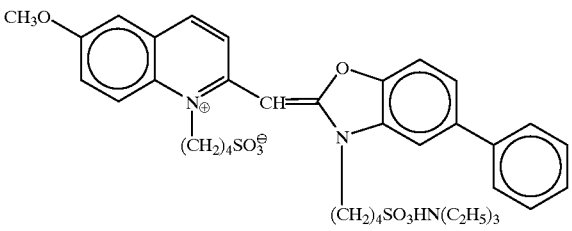
-continued
S-1
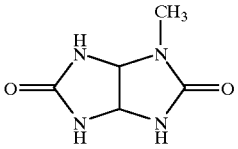
H-1
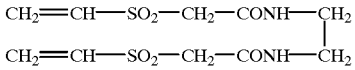
B-1
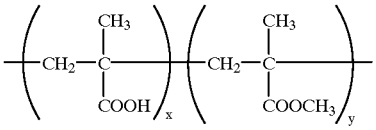
x/y = 10/90(weight ratio)
Average mol. wt.: about 35,000
B-2
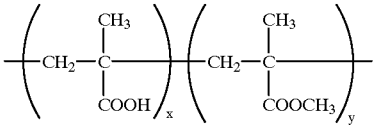
x/y = 40/60(weight ratio)
Average mol. wt.: about 20,000
B-3
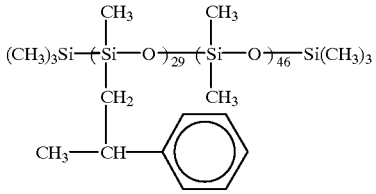
(Molar ratio)
Average mol. wt.: about 8,000
B-4
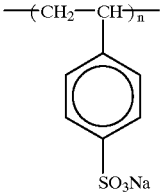
Average mol. wt.: about 750,000
B-5
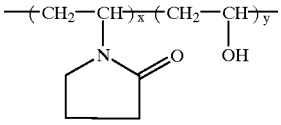
x/y = 70/30 (weight ratio)
Average mol. wt.: about 17,000
B-6
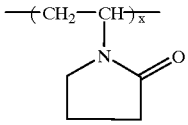
Average mol. wt.: about 10,000

-continued
W-1
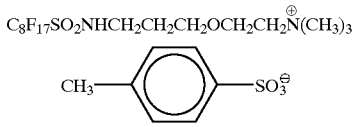
W-2
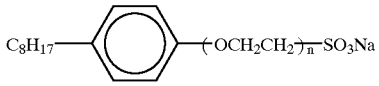
n = 2–4
W-3
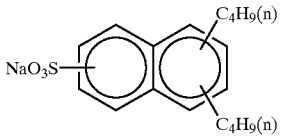
W-4
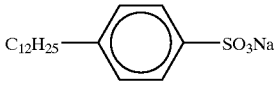
W-5
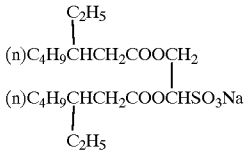
F-1
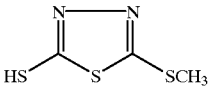
F-2
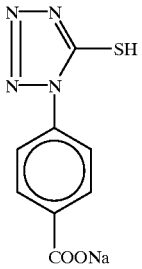
F-3
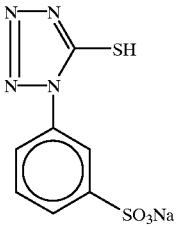
F-4
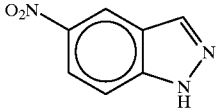
F-5
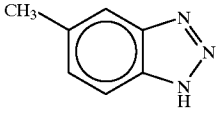
-continued
F-6
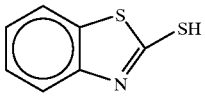
F-7
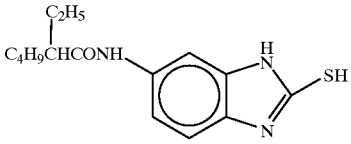
F-8
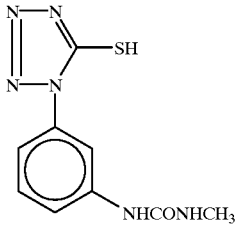
F-9
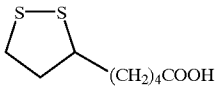
F-10
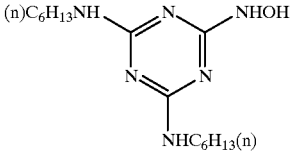
F-11
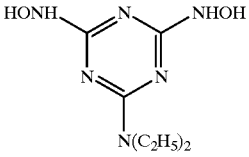
F-12
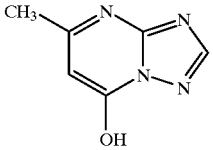
F-13
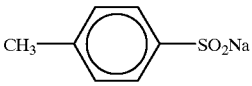
F-14
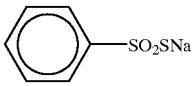
F-15
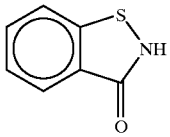

-continued

F-16

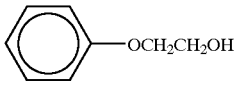

F-17

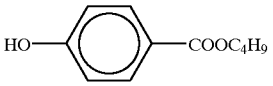

F-18

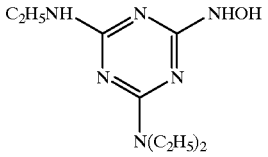

Each of the samples was developed according to the following procedure.

(Processing steps)

| Step | Time | Temp. |
|---|---|---|
| Color development | 3 min 15 sec | 38° C. |
| Bleaching | 3 min 00 sec | 38° C. |
| Washing | 30 sec | 24° C. |
| Fixing | 3 min 00 sec | 38° C. |
| Washing (1) | 30 sec | 24° C. |
| Washing (2) | 30 sec | 24° C. |
| Stabilization | 30 sec | 38° C. |
| Drying | 4 min 20 sec | 55° C. |

The composition of each processing solution was as follows.

| (Color developer) | (unit: g) |
|---|---|
| Diethylenetriaminepentaacetic acid | 1.0 |
| 1-Hydroxyethylidene-1,1-diphosphonic acid | 2.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-[N-ethyl-N-(β-hydroxyethyl)amino]-2-methylaniline sulfate | 4.5 |
| Water | q.s. ad 1.0 lit. |
| pH | 10.05 |

This pH was adjusted by the use of sulfuric acid and potassium hydroxide.

| (Bleach-fix soln.) | (unit: g) |
|---|---|
| Fe (III) sodium ethylenediaminetetraacetate trihydrate | 100.0 |
| Disodium ethylenediaminetetraacetate | 10.0 |
| 3-Mercapto-1,2,4-triazole | 0.03 |
| Ammonium bromide | 140.0 |
| Ammonium nitrate | 30.0 |
| Aq. ammonia (27%) | 6.5 ml |
| Water | q.s. ad 1.0 lit. |
| pH | 6.0 |

This pH was adjusted by the use of aqueous ammonia and nitric acid.

| (Fixing soln.) | (unit: g) |
|---|---|
| Disodium ethylenediaminetetraacetate | 0.5 |
| Sodium sulfite | 20.0 |
| Aq. soln. of ammonium thiosulfate (700 g/lit.) | 295.0 ml |
| Acetic acid (90%) | 3.3 |
| Water | q.s. ad 1.0 lit. |
| pH | 6.7 |

This pH was adjusted by the use of aqueous ammonia and acetic acid.

| (Stabilizer soln.) | (unit: g) |
|---|---|
| p-Nonylphenoxypolyglycidol (glycidol av. polymn. deg: 10) | 0.2 |
| Ethylenediaminetetraacetic acid | 0.05 |
| 1,2,4-Triazole | 1.3 |
| 1,4-Bis(1,2,4-triazol-1-ylmethyl)piperazine | 0.75 |
| Hydroxyacetic acid | 0.02 |
| Hydroxyethylcellulose (HEC SP-2000 produced by Daicel Chemical Industries, Ltd.) | 0.1 |
| 1,2-Benzisothiazolin-3-one | 0.05 |
| Water | q.s. ad 1.0 lit. |
| pH | 8.5. |

Samples 202 and 203 were prepared in the same manner as the sample 201, except that the Cpd-1 in the 7th layer and the 12th layer of the sample 201 was replaced by an equimolar amount of compound example (3) and compound example (32) of the present invention, respectively.

Two pieces of each of the above samples were subjected to wedge exposure for sensitometry. One thereof was immediately subjected to the above development processing, and the other was held in an atmosphere of 50° C./60% RH for 3 days and thereafter subjected to the above development processing in order to examine the latent image stability of the lightsensitive material.

The samples of the present invention exhibited excellent color mixing inhibiting capability and excellent latent image stability (little fog increase and little sensitivity/gradation change).

Example 3

Sample of the present invention was prepared in the same manner as the sample 112 of Example 1 of JP-A-10-3147, except that the color mixing inhibitor Cpd-4 in the 2nd layer (color mixing inhibiting layer) and 4th layer (color mixing inhibiting layer) of the sample 112 was replaced by an equimolar amount of each of compound example (3) and compound example (41) of the present invention, respectively. The sample of the present invention exhibited excellent color mixing inhibiting capability and excellent cyan color image light fastness.

Example 4

Sample of the present invention was prepared in the same manner as the sample 201 of Example 2 of JP-A-9-5912, except that the color mixing inhibitors Cpd-D and Cpd-G in the 7th layer (interlayer) and color mixing inhibitors Cpd-B, Cpd-D and Cpd-G in the 13th layer (yellow filter layer) of the sample 201 were replaced by an equimolar amount of compound example (5) of the present invention. Another sample of the invention was prepared by replacing the compound (5) of the above sample of the invention by the compound (65) of the present invention. The samples of the present invention exhibited excellent color mixing inhibiting capability and excellent latent image stability.

Example 5

Two samples of the present invention were prepared in the same manner as the sample 201 of Example 2 of JP-A-1-129252, except that 0.02 g/m$^2$ of the compound example (3) was added to the 13th layer of the sample 201, and compound example (41) of the present invention was added to the 13th layer of the sample 201. The samples of the present invention exhibited excellent graininess.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide color photographic lightsensitive material comprising a compound represented by general formula (I):

COUP—A—E—B (I)

wherein COUP represents a coupler residue capable of coupling with a developing agent in an oxidized form; E represents an electrophilic moiety; A represents a single bond or a divalent connecting group which can release B while forming a 4 to 8-membered ring through an intramolecular nucleophilic substitution reaction between the electrophilic moiety E and a nitrogen atom of a coupling product that is obtained by the reaction of COUP with the developing agent in an oxidized form, wherein the nitrogen atom originates from the developing agent and directly binds to a coupling position of COUP, provided that A may be bound to COUP at the coupling position or position other than the coupling position of COUP; and B represents a photographically inert group.

2. The material according to claim 1, wherein general formula (I) is represented by formula (I-3) below, in which A bonds to the atom adjacent to the adjacent atom of the coupling position of COUP:

(I-3)

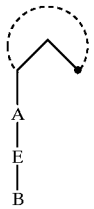

wherein

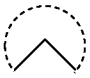

represents the coupler moiety, COUP; the dot, ., represents the coupling position; the solid line, —, represents a bonding between non-metallic atoms; and A, E and B have the same meaning as in claim 1.

3. The material according to claim 1, wherein general formula (I) is represented by formula (I-3a):

(I-3a)

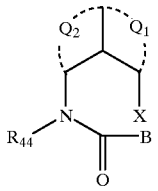

wherein each of $Q_1$ and $Q_2$ represents a nonmetallic atomic group which forms a 5- or 6-membered ring and which is required for inducing a coupling reaction with the developing agent in an oxidized form by the atom of the root portion of X; X represents a hydrogen atom, a halogen atom, $R_{31}$—, $R_{31}O$—, $R_{31}S$—, $R_{31}OCOO$—, $R_{32}COO$—, $R_{32}(R_{33})NCOO$— or $R_{32}CON(R_{33})$—, wherein $R_{31}$ represents an aliphatic group, an aryl group or a heterocyclic group; each of $R_{32}$ and $R_{33}$ independently represents a hydrogen atom, an aliphatic group, an aryl group or a heterocyclic group; $R_{44}$ represents an aliphatic group, an aryl group or a heterocyclic group; and B represents a photographically inert group.

4. The material according to claim 1, wherein general formula (I) is represented by formula (I-3b):

(I-3b)

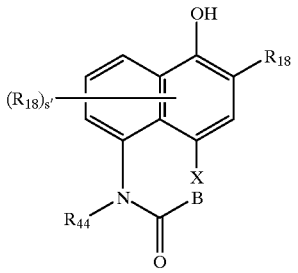

wherein X represents a hydrogen atom, a halogen atom, $R_{31}$—, $R_{31}O$—, $R_{31}S$—, $R_{31}OCOO$—, $R_{32}COO$—, $R_{32}(R_{33})NCOO$— or $R_{32}CON(R_{33})$—, wherein $R_{31}$ represents an aliphatic group, an aryl group or a heterocyclic group; each of $R_{32}$ and $R_{33}$ independently represents a hydrogen atom, an aliphatic group, an aryl group or a heterocyclic group; $R_{18}$ represents a substituent selected from the group consisting of $R_{32}CON(R_{33})$—, $R_{31}OCON(R_{32})$—, $R_{31}SO_2N(R_{32})$—, $R_{32}(R_{33})NCON(R_{34})$—, $R_{31}S$—, $R_{31}O$—, $R_{32}(R_{33})NCO$—, $R_{32}(R_{33})NSO_2$—, $R_{31}OCO$—, a cyano group and a halogen atom, wherein $R_{31}$ represents an aliphatic group, an aryl group or a heterocyclic group, and each of $R_{32}$ and $R_{33}$ independently represents a hydrogen atom, an aliphatic group, an aryl group or a heterocyclic group; s' represents an integer from 0 to 4; and $R_{44}$ represents an aliphatic group, an aryl group or a heterocyclic group.

5. The material according to claim 1, wherein the general formula (I) is represented by formula (I-3c):

(I-3c)

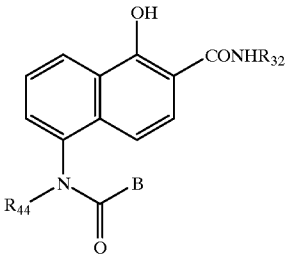

wherein $R_{32}$ represents a hydrogen atom, an aliphatic group, an aryl group or a heterocyclic group; $R_{44}$ represents an aliphatic group, an aryl group or a heterocyclic group; and B represents a photographically inert group.

6. The material according to claim 1, wherein E of general formula (I) is a carbonyl group.

7. The material according to claim 1, wherein B of general formula (I) is selected from the following groups:

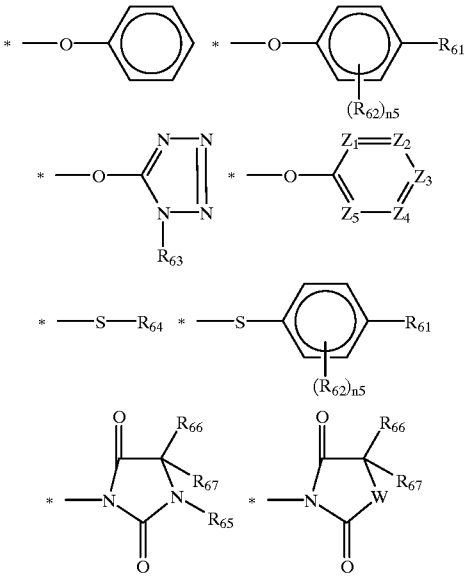

-continued

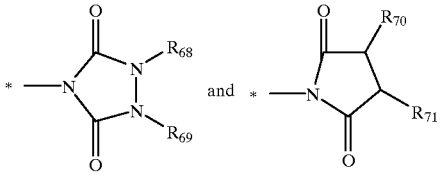

wherein, * represents the position at which the group is bonded to E; $R_{61}$ represents a nitro group, a cyano group, a trifluoromethyl group, a carboxyl group, a sulfo group, an aliphatic group, an aryl group, a carbamoyl group, a sulfamoyl group, an alkoxycarbonyl group, an acylamino group, an alkylsulfonyl group or arylsulfonyl group; $R_{62}$ represents a halogen atom, a nitro group, a cyano group, a trifluoromethyl group, a carboxyl group, a sulfo group, an aliphatic group, an aryl group, a carbamoyl group, a sulfamoyl group, an alkoxycarbonyl group, an acylamino group, an alkylsulfonyl group, an arylsulfonyl group, an alkoxy group or an aryloxy group; n5 is an integer of 0 to 4, wherein when n5 is 2 or greater, a plurality of groups $R_{62}$ may be identical with or different from each other; $R_{63}$ represents an aliphatic group, an aryl group or a heterocyclic group; each of $Z_1$, $Z_2$, $Z_4$ and $Z_5$ independently represents CH, $C(R_{62})$ or a nitrogen atom; $Z_3$ represents CH, $C(R_{61})$ or a nitrogen atom, provided that at least one of $Z_1$, $Z_2$, $Z_3$, $Z_4$ and $Z_5$ represents a nitrogen atom; $R_{64}$ represents an unsubstituted aliphatic group or a substituted aliphatic group whose substituents is a halogen atom; $R_{65}$ represents a hydrogen atom, an aliphatic group or an acyl group; each of $R_{66}$ and $R_{67}$ independently represents a hydrogen atom, an aliphatic group, an aryl group, an aliphatic oxy group, an aryloxy group or a hydroxyl group; W represents an oxygen atom or a sulfur atom; each of $R_{68}$ and $R_{69}$ independently represents a hydrogen atom, an aliphatic group, wherein $R_{68}$ and $R_{69}$ may be bonded with each other so as to form a 3- to 8-membered ring; each of $R_{70}$ and $R_{71}$ independently represents a hydrogen atom, an aliphatic group, an aryl group, an aliphatic oxy group, an aryloxy group or a hydroxyl group, wherein $R_{70}$ and $R_{71}$ may be bonded with each other so as to form a 3- to 8-membered ring.

8. The material according to claim 1, wherein B of general formula (I) is a phenoxy group.

9. The material according to claim 1, wherein B of general formula (I) is a p-nitrophenoxy group.

* * * * *